US007441521B2

(12) United States Patent
Asada et al.

(10) Patent No.: US 7,441,521 B2
(45) Date of Patent: Oct. 28, 2008

(54) VARIABLE VALVE MECHANISM

(75) Inventors: Toshiaki Asada, Mishima (JP); Shuichi Ezaki, Susono (JP); Manabu Tateno, Nagaizumi-cho (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 473 days.

(21) Appl. No.: 10/553,279

(22) PCT Filed: Dec. 8, 2004

(86) PCT No.: PCT/JP2004/018673

§ 371 (c)(1),
(2), (4) Date: Oct. 14, 2005

(87) PCT Pub. No.: WO2005/059321

PCT Pub. Date: Jun. 30, 2005

(65) Prior Publication Data

US 2006/0219196 A1 Oct. 5, 2006

(30) Foreign Application Priority Data

Dec. 18, 2003 (JP) ..... 2003-421278
Dec. 24, 2003 (JP) ..... 2003-426334

(51) Int. Cl.
*F01L 1/34* (2006.01)

(52) U.S. Cl. ..... 123/90.16; 123/90.2; 123/90.44; 74/569; 477/97

(58) Field of Classification Search ..... 123/90.16, 123/90.2, 90.39, 90.44, 90.27, 90.31, 90.6, 123/678; 74/53, 55, 559, 567, 569; 477/97
See application file for complete search history.

(56) References Cited

U.S. PATENT DOCUMENTS

| | | | | |
|---|---|---|---|---|
| 5,373,818 | A | 12/1994 | Unger | |
| 6,019,076 | A | 2/2000 | Pierik et al. | |
| 6,311,659 | B1 | 11/2001 | Pierik | |
| 7,117,831 | B2 * | 10/2006 | Methley | 123/90.16 |

FOREIGN PATENT DOCUMENTS

| | | |
|---|---|---|
| GB | 947147 | 1/1964 |
| JP | A 7-63023 | 3/1995 |
| JP | A 7-293216 | 11/1995 |
| JP | A 2001-207876 | 8/2001 |
| JP | A 2003-269124 | 9/2003 |
| WO | WO 95/09298 A1 | 4/1995 |

* cited by examiner

*Primary Examiner*—Ching Chang
(74) *Attorney, Agent, or Firm*—Oliff & Berridge, PLC

(57) ABSTRACT

A first arm member and a second arm member are provided. The first arm member is positioned between a cam and a valve body to oscillate in synchronism with the rotation of the cam. The second arm member changes the angle of the first arm member in accordance with the rotation angle of a control shaft. The temperature prevailing in the neighborhood of the control shaft and cam is detected. The rotation angle of the control shaft is corrected so as to avoid the influence of the detected temperature.

21 Claims, 11 Drawing Sheets

VARIABLE VALVE MECHANISM

TECHNICAL FIELD

The present invention relates to a variable valve mechanism, and more particularly to an internal combustion engine's variable valve mechanism that is capable of changing the operating angle and lift amount of a valve that opens in synchronism with camshaft rotation.

BACKGROUND ART

A conventional variable valve mechanism disclosed, for instance, by Japanese Patent Laid-Open No. 63023/1995 changes the lift amount of a valve body in an internal combustion engine that is equipped with the valve body, which opens/closes in synchronism with camshaft rotation. This variable valve mechanism is provided with a swinging arm that is positioned between a cam and valve body to swing in synchronism with a cam operation. The swinging arm is built in the internal combustion engine in such a manner that its basic relative angle in relation to the valve body is variable. Further, the mechanism includes a lost motion spring and adjustment mechanism. The lost motion spring controls the motion of the swinging arm by directing the swinging arm toward the cam. The adjustment mechanism changes the relative angle of the swinging arm to the valve body in accordance with control shaft rotation.

In the variable valve mechanism described above, the lost motion spring works so that the cam is in constant mechanical contact with the swinging arm. Therefore, the variable valve mechanism can constantly transmit the mechanical force generated by the cam to the valve body without any loss. Further, the variable valve mechanism can change the reference relative angle of the swinging arm to the valve body by rotating the control shaft. When the relative angle changes, the time (crank angle) required for the swinging arm to start depressing the valve body can be changed after the cam's pushing pressure begins to be transmitted to the swinging arm, that is, after the swinging arm begins swinging due to cam action.

When the time required for the swinging arm to start depressing the valve body changes, the crank angle width (hereinafter referred to as the "operating angle") for placing the valve body in a non-closed state changes so that the profile of the lift amount for the valve body changes. Therefore, the conventional mechanism described above can change the operating angle and lift amount or the valve body with a high degree of freedom.

Including the above-mentioned document, the applicant is aware of the following documents as a related art of the present invention.

[Patent Document 1] Japanese Patent Laid-Open No. 63023/1995

[Patent Document 2] Japanese Patent Laid-Open No. 293216/1995

DISCLOSURE OF INVENTION

However, the ambient temperature of the variable valve mechanism greatly changes in accordance, for instance, with the operating status of an internal combustion engine. In the aforementioned conventional mechanism, therefore, the sections around the control shaft and camshaft are frequently subject to significant expansion or shrinkage due to a temperature change. Such thermal deformation changes the status of the swinging arm, which is positioned between the control shaft and cam, and the status of the adjustment mechanism, which changes the angle of the swinging arm.

More specifically, when the ambient temperature of the above conventional mechanism increases, thermal deformation occurs so as to increase the spacing interval between the control shaft and camshaft. As a result, the status of the swinging arm changes in the direction of providing a smaller lift. On the contrary, if the ambient temperature of the variable valve mechanism decreases, the spacing interval between the control shaft and camshaft decreases so that the status of the swinging arm changes in the direction of providing a greater lift. Therefore, the above-mentioned variable valve mechanism is at a disadvantage in that the valve body's operating angle and lift amount change due to the influence of a temperature change in the neighborhood of the valve body no matter what the status of the control shaft is.

The present invention has been made to solve the above problems. It is an object of the present invention to provide a variable valve mechanism that is capable of constantly providing the valve body with a desired valve-opening characteristic without being affected by a temperature change.

The above object is achieved by a variable valve mechanism according to a first aspect of the present invention. The variable valve mechanism is capable of changing the operating angle and/or lift amount of a valve body of an internal combustion engine. The variable valve mechanism may include a control shaft whose status is controlled so as to change the operating angle and/or lift amount. The mechanism may also include a swinging arm that is positioned between a cam and a valve body to swing in synchronism with cam rotation, thereby transmitting the force of the cam to the valve body. The mechanism may further include an adjustment mechanism for changing the basic relative angle of the swinging arm in relation to the valve body in accordance with the status of the control shaft. A temperature detection unit may be provided for detecting or estimating the ambient temperature of the control shaft and the cam. A temperature correction unit may also be provided for correcting the status of the control shaft in accordance with the temperature and in order to avoid the influence of the temperature.

In a second aspect of the present invention, the variable valve mechanism according to the first aspect of the present invention may further include a sensor for detecting the status of the control shaft. The mechanism may also include an actuator for driving the control shaft. The mechanism may further include an actuator control unit for controlling a control value of the actuator in accordance with the output of the sensor. The temperature correction unit may correct the control value of the actuator in accordance with the temperature.

In a third aspect of the present invention, the temperature correction unit in the second aspect of the present invention may correct the output of the sensor in accordance with the temperature. The actuator control unit may controls the control value of the actuator in accordance with the corrected sensor output.

In a fourth aspect of the present invention, the variable valve mechanism according to the first aspect of the present invention may further include a sensor for detecting the status of the control shaft. An actuator may be provided for driving the control shaft. A target status setup unit may be provided for setting the target status of the control shaft. An actuator control unit may be provided for controlling the actuator so that the output. of the sensor matches the target status of the control shaft. The temperature correction unit may correct the target status of the control shaft in accordance with the temperature.

The above object is achieved by a variable valve mechanism according to a fifty aspect of the present invention. The variable valve mechanism is capable of changing the operating angle and/or lift amount of a valve body of an internal combustion engine. The variable valve mechanism may include a control shaft whose status is controlled so as to change the operating angle and/or lift amount. The mechanism may also include a swinging arm that is positioned between a cam and a valve body to oscillate in synchronism with cam rotation, thereby transmitting the force of the cam to the valve body. The mechanism further includes an adjustment mechanism for changing the basic relative angle of the swinging arm in relation to the valve body in accordance with the status of the control shaft. A member for determining the distance between the control shaft and a camshaft and a member positioned between the control shaft and the cam are made of materials having the same linear expansion coefficient.

In a sixth aspect of the present invention, the temperature correction unit of the first aspect of the present invention may include a status detection sensor for detecting the status of the control shaft. The temperature correction unit may also include a stop state temperature acquisition unit for acquiring the ambient temperature at the time of an internal combustion engine stop as a stop state temperature. The temperature correction unit may further include a stop state characteristic value detection unit for detecting the operating angle and/or the lift amount at the time of an internal combustion engine stop as a stop state characteristic value in accordance with the status of the control shaft. A non-corrective restart state characteristic value calculation unit may be provided for calculating a non-corrective restart state characteristic value in accordance with the stop state characteristic value and the difference between an assumed restart temperature of the internal combustion engine and the stop state temperature. A correction value calculation unit may be also provided for calculating a correction value for converting the non-corrective restart state characteristic value into an operating angle and/or lift amount suitable for the assumed restart temperature. A pre-startup correction unit may be further provided for correcting the status of the control shaft prior to an internal combustion engine restart so that the operating angle and/or lift amount change in accordance with the correction value.

In a seventh aspect of the present invention, the pre-startup correction unit of the sixth aspect of the present invention may correct the status of the control shaft at time of an internal combustion engine stop so that the operating angle and/or lift amount change in accordance with the correction value.

In an eighth aspect of the present invention, the assumed restart temperature of the sixth or seventh aspect of the present invention may be the lowest temperature within an operating temperature range of the internal combustion engine.

In a ninth aspect of the present invention, the temperature correction unit of the first aspect of the present invention may include a status detection sensor for detecting the status of the control shaft. The temperature correction unit may also include a stop state temperature acquisition unit for acquiring the ambient temperature at the time of an internal combustion engine stop as a stop state temperature. The temperature correction unit may further include a stop state characteristic value detection unit for detecting the operating angle and/or the lift amount at the time of an internal combustion engine stop as a stop state characteristic value in accordance with the status of the control shaft. A stop period temperature acquisition unit may be provided for acquiring the ambient temperature during an internal combustion engine stop as a stop period temperature. A stop period correction unit may be also provided for correcting the status of the control shaft during an internal combustion engine stop so that the operating angle and/or lift amount are maintained suitable for a restart in accordance with the stop state temperature, the stop state characteristic value, and the stop period temperature.

In a tenth aspect of the present invention, the stop period correction unit of the ninth aspect of the present invention may further include a first characteristic value change amount calculation unit for calculating a first characteristic value change amount in accordance with the stop state temperature and the stop period temperature. The stop period correction unit may also includes a first actual characteristic value calculation unit for calculating the sum of the stop state characteristic value and the first characteristic value change amount as an actual characteristic value. The stop period correction unit may further include a suitability judgment unit for judging whether the calculated actual characteristic value is suitable for a restart. A control shaft correction unit may be provided for correcting the status of the control shaft so that the actual characteristic value is suitable for a restart when the actual characteristic value is judged to be unsuitable for a restart. A post-correction characteristic value calculation unit may be provided for calculating a post-correction characteristic value that is obtained by correcting the control shaft. A second characteristic value change amount calculation unit may be also provided for calculating a second characteristic value change amount in accordance with a change in the stop period temperature that is caused after the control shaft is corrected. A second actual, characteristic value calculation unit may be further provided for calculating the sum of the post-correction characteristic value and the second characteristic value change amount as an actual characteristic value.

In an eleventh aspect of the present invention, the temperature correction unit of the first aspect of the present invention may include a status detection sensor for detecting the status of the control shaft. The temperature correction unit may also include a stop state temperature acquisition unit for acquiring the ambient temperature at the time of an internal combustion engine stop as a stop state temperature. The temperature correction unit may further include a stop state characteristic value detection unit for detecting the operating angle and/or the lift amount at the time of an internal combustion engine stop as a stop state characteristic value in accordance with the status of the control shaft. A restart request state temperature acquisition unit may be provided. for acquiring the ambient temperature upon a request for an internal combustion engine restart as a restart request state temperature. A non-corrective restart request state characteristic value calculation unit may be provided for calculating a non-corrective restart request state characteristic value in accordance with the stop state characteristic value and the difference between the restart request state temperature and the stop state temperature. A correction value calculation unit may be also provided for calculating a correction value for converting the non-corrective restart request state characteristic value into a characteristic value suitable for a restart. A pre-restart correction unit may be further provided for correcting the status of the control shaft prior to an internal combustion engine restart so that the operating angle and/or lift amount change in accordance with the correction value.

In a twelfth aspect of the present invention, the internal combustion engine of any one of the ninth through eleventh aspect of the present invention may be capable of automatically stopping and starting without requiring an operator intervention.

According to a first aspect of the present invention, the status of the adjustment mechanism and swinging arm, which are positioned between the control shaft and cam, can be changed by rotating the control shaft for the purpose of changing the valve opening characteristic of the valve body. The present invention makes it possible to correct the status of the control shaft in accordance with the temperature prevailing in the neighborhood of the control shaft and cam, thereby avoiding the influence of a change in that temperature. As a result, the present invention can constantly provide the valve body with a desired valve opening characteristic without being affected by a temperature change.

According to a second aspect of the present invention, the control shaft can be placed in a desired state by detecting the control shaft status with a sensor and controlling an actuator's control value in accordance with the output of the sensor. In this instance, the present invention can avoid the influence of a temperature change by correcting the actuator control valve in accordance with the temperature.

According to a third aspect of the present invention, the sensor output for detecting the control shaft status can be corrected in accordance with the temperature prevailing in the neighborhood of the control shaft and cam. Therefore, the present invention makes it possible to obtain a sensor output in which the influence of the temperature is reflected. The influence of a temperature change can be avoided by controlling the actuator control value in accordance with the corrected sensor output.

According to a fourth aspect of the present invention, the control shaft can be placed in a desired state by detecting the control shaft status with a sensor and controlling the actuator in accordance with the output of the sensor. In this instance, the present invention can accurately avoid the influence of a temperature change by correcting the target control shaft state to be attained.

According to a fifth aspect of the present invention, the status of the adjustment mechanism and swinging arm, which are positioned between the control shaft and cam, can be changed by rotating the control shaft for the purpose of changing the valve opening characteristic of the valve body. Since the member for determining the distance between the control shaft and camshaft and the member positioned between the control shaft and cam are made of materials having the same linear expansion coefficient, the present invention can prevent the swinging arm status from being changed by a temperature change. As a result, the present invention can constantly provide the valve body with a desired valve opening characteristic without being affected by a temperature change.

According to a sixth aspect of the present invention, the status of the adjustment mechanism and swinging arm, which are positioned between the control shaft and cam, can be changed by rotating the control shaft for the purpose of changing the valve opening characteristic of the valve body. The present invention makes it possible to calculate the operating angle and/or lift amount that are generated when the internal combustion engine restarts with the control shaft status left uncorrected (non-corrective restart state characteristic value), in accordance with the difference between the temperature prevailing during an internal combustion engine stop (stop state temperature) and the assumed restart temperature of the internal combustion engine and with the operating angle and/or lift amount prevailing during an internal combustion engine stop (stop state characteristic value), and calculate a correction value for converting the non-corrective restart state characteristic value into a characteristic value suitable for the assumed restart temperature. Since a correction is subsequently made in accordance with the correction value prior to an internal combustion engine restart, the valve body can be constantly provided with an optimum valve opening characteristic at the assumed temperature when the internal combustion engine restarts.

According to a seventh aspect of the present invention, the correction for acquiring an optimum valve opening characteristic at the assumed temperature can be made during an internal combustion engine stop. Therefore, the present invention makes it possible to restart the internal combustion engine immediately after a restart request is generated.

According to an eighth aspect of the present invention, the valve body can be provided at internal combustion engine startup with an optimum valve opening characteristic that prevails at the lowest temperature within the operating temperature range. Therefore, the. present invention makes it possible to properly start up the internal combustion engine within the entire operating temperature range.

According to a ninth aspect of the present invention, the status of the adjustment mechanism and swinging arm, which are positioned between the control shaft and cam, can be changed by rotating the control shaft for the purpose of changing the valve body's valve opening characteristic. The present invention can maintain an appropriate operating angle and/or lift amount for a restart during an internal combustion engine stop by controlling the control shaft status in accordance with the temperature prevailing upon an internal combustion engine stop (stop state temperature), the temperature prevailing during an internal combustion engine stop (stop period temperature), and the operating. angle and/or lift amount prevailing upon an internal combustion engine stop (stop state characteristic value). As a result, the present invention can always provide the valve body with an optimum valve opening characteristic at an internal combustion engine restart.

According to a tenth aspect of the present invention, the amount of an operating angle change and/or lift amount change from the stop state characteristic value (first characteristic value change amount) can be calculated in accordance with the difference between the stop state temperature and stop period temperature. Further, the actual operating angle and/or actual lift amount can be calculated by adding the calculated change amount to the stop state characteristic value. If the calculated actual operating angle and/or actual lift amount are not suitable for a restart, the control shaft status can be corrected so that the actual operating angle and/or actual lift amount are suitable for a restart. Subsequently, the actual operating angle and/or actual lift amount are recalculated by determining the sum of the operating angle or lift amount corrected above (post-correction characteristic value) and the amount of an operating angle change and/or lift amount change caused by a temperature change after the correction (second characteristic value change amount). The control shaft is then corrected each time the calculation results deviate from values suitable for startup. As a result, the actual operating angle and/or actual lift amount are maintained suitable for a restart.

According to an eleventh aspect of the present invention, the status of the adjustment mechanism and swinging arm, which are positioned between the control shaft and cam, can be changed by rotating the control shaft for the purpose of changing the valve body's valve opening characteristic. When a request for an internal combustion engine restart is generated, the present invention can calculate an operating angle and/or lift amount that are generated when the internal combustion engine is restarted during the status prevailing during the stop state (non-corrective restart request state characteristic value), in accordance with the difference between the temperature prevailing upon an internal combustion engine stop (stop state temperature) and the temperature prevailing upon receipt of the request (restart request state temperature) and with an operating angle and/or lift amount prevailing upon an internal combustion engine stop (stop state characteristic value), and continue to calculate a correction value for converting the non-corrective restart request state characteristic value into a value suitable for a restart. Subsequently, a correction is made in accordance with the correction value prior to an internal combustion engine restart so that the valve body is constantly provided with an optimum valve opening characteristic for a restart.

According to a twelfth aspect of the present invention, an internal combustion engine having an automatic stop function and automatic startup function can constantly provide the valve body with an optimum valve opening characteristic at a restart. In an internal combustion engine having the above functions, the startup and stop sequences are repeated. Therefore, when the startability is improved by the present invention, the condition of the internal combustion engine can be remarkably improved.

BEST MODE FOR CARRYING OUT THE INVENTION

First Embodiment

[Overall Configuration of the Variable Valve Mechanism]

Figure 1A:
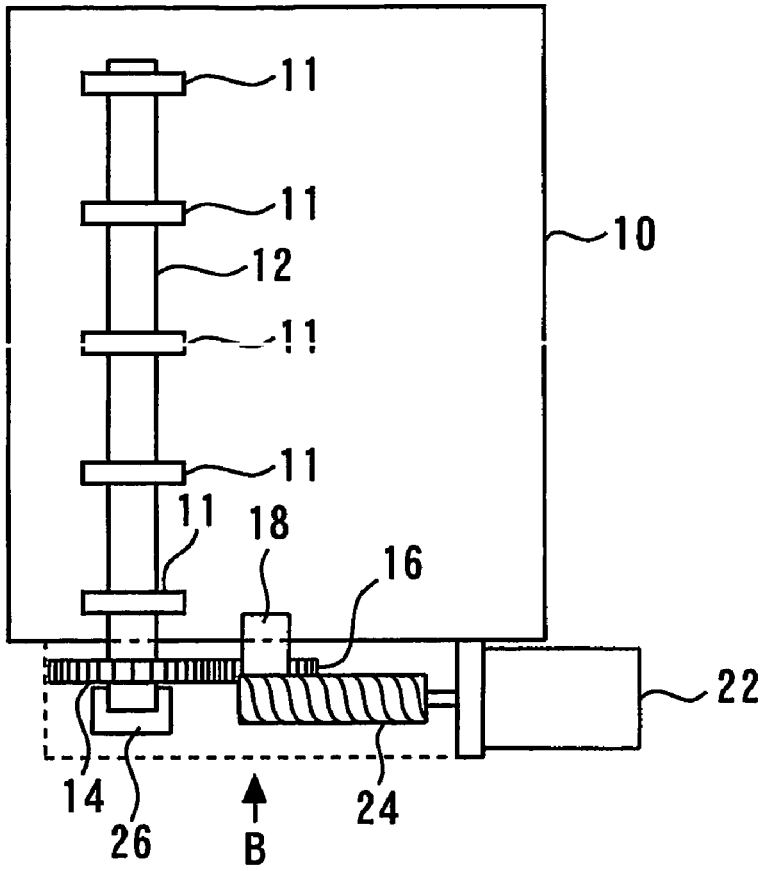
FIGS. 1A and 1B illustrate the overall configuration of a variable valve mechanism according to a first embodiment of the present invention.
Figure 1B:
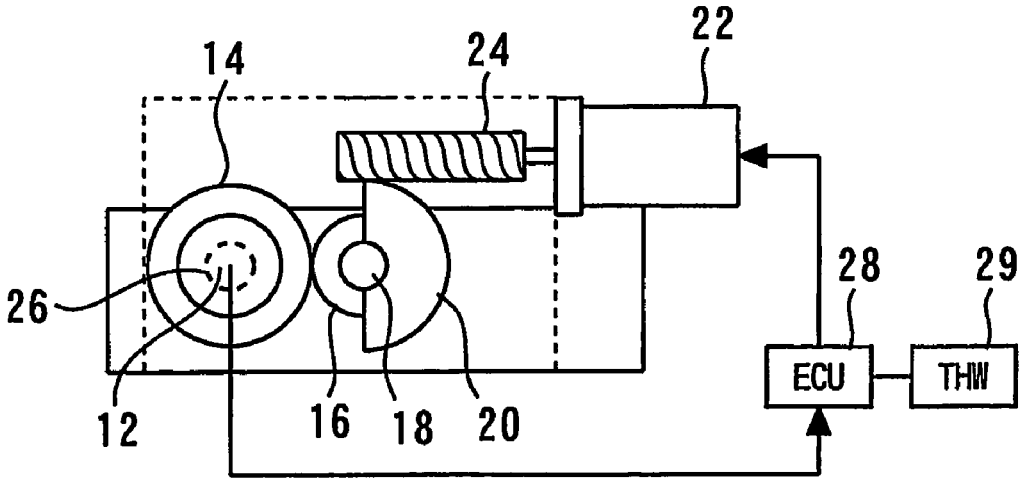

FIGS. 1A and 1B illustrate the overall configuration of a variable valve mechanism according to a first embodiment of the present invention. More specifically, FIG. 1A is a plan view illustrating the entire variable valve mechanism, and FIG. 1B is a side view that represents view B of FIG. 1A.

The configuration shown in FIGS. 1A and 1B contains a cylinder head 10 of an internal combustion engine. The cylinder head 10 has a plurality of control shaft bearings 11, which are positioned on both sides of each cylinder. The control shaft bearings 11 retain a control shaft 12 in such a manner that the control shaft 12 can rotate. The internal combustion engine according to the present embodiment has four cylinders that are arranged in series. The control shaft 12 is positioned to run longitudinally over the four cylinders.

Each cylinder of the internal combustion engine has an intake valve and an exhaust valve, which open/close in synchronism with cam rotation (these valves are not shown in FIG. 1A or 1B). The variable valve mechanism according to the present embodiment is a mechanism for allowing at least the intake valve of each cylinder to change its operating angle and lift amount. The above-mentioned control shaft 12 is a component whose rotation position is controlled to permit operating angle and lift amount changes.

When the intake valve operating angle and lift amount can be freely changed, it is possible to control the intake air amount by controlling the intake valve operating angle and lift amount without using a throttle valve. When the intake air amount is controlled in such a manner, it is possible to prevent the intake pipe pressure from being negative, thereby avoiding a pumping loss within the internal combustion engine. It is assumed that the internal combustion engine according to the present embodiment is of a throttle-less type, which provides the above advantage by controlling the intake air amount with the variable valve mechanism without using a throttle valve. The variable valve mechanism will be described in detail later with reference to FIGS. 2, 3, 4A, 4B, 5A, and 5B.

A first gear 14, which is a spur gear, is fastened to an end of the control shaft 12. The first gear 14 meshes with a second gear 16, which is also a spur gear. A rotation shaft 18 is fastened to the center of the second gear 16. As shown in FIG. 1B, a semicircular worm wheel 20 is fastened to the rotation shaft 18 and superposed over the second gear 16. The worm wheel 20 meshes with a worm gear 24, which is fastened to the rotation shaft of a motor 22. When the configuration described above is employed, the rotation position of the control shaft 12 can be controlled by controlling the rotation of the motor 22.

A rotation angle sensor 26 is also mounted on the end of the control shaft 12 in order to detect the rotation position of the control shaft 12. The output of the rotation angle sensor 26 is supplied to an ECU (Electronic Control Unit) 28. A water temperature sensor 29 is electrically connected to the ECU 28 in order to detect the cooling water temperature THW of the internal combustion engine. The ECU 28 can detect the outputs of the rotation angle sensor 26 and water temperature sensor 29, and control the status of the motor 22.

The relationship between the output of the rotation angle sensor 26 and the actual rotation position of the control shaft 12 does not remain the same in all situations depending, for instance, on the individual specificity of the sensor, mechanism variations, and their changes with time. Under these circumstances, the ECU 28 is capable, for instance, of rotating the control shaft 12 until one of its control ends is reached immediately after internal combustion engine startup (this process is hereinafter referred to as a "strike process") and calibrating its output in accordance with the resulting sensor output. Therefore, the ECU 28 can accurately detect the rotation position of the control shaft 12 in accordance with the output from the rotation angle sensor 26 without being affected by the above-mentioned changes with time and the like.

[Detailed Configuration of the Variable Valve Mechanism]

The mechanical configuration and operation of the variable valve mechanism according to the present embodiment will now be described in relation to individual cylinders. In the following description, the mechanism is referred to as the variable valve mechanism with reference numeral 30 assigned. It is also assumed that each cylinder of the internal combustion engine is equipped with two intake valves and that each variable valve mechanism 30 drives two intake valves.

Figure 2:
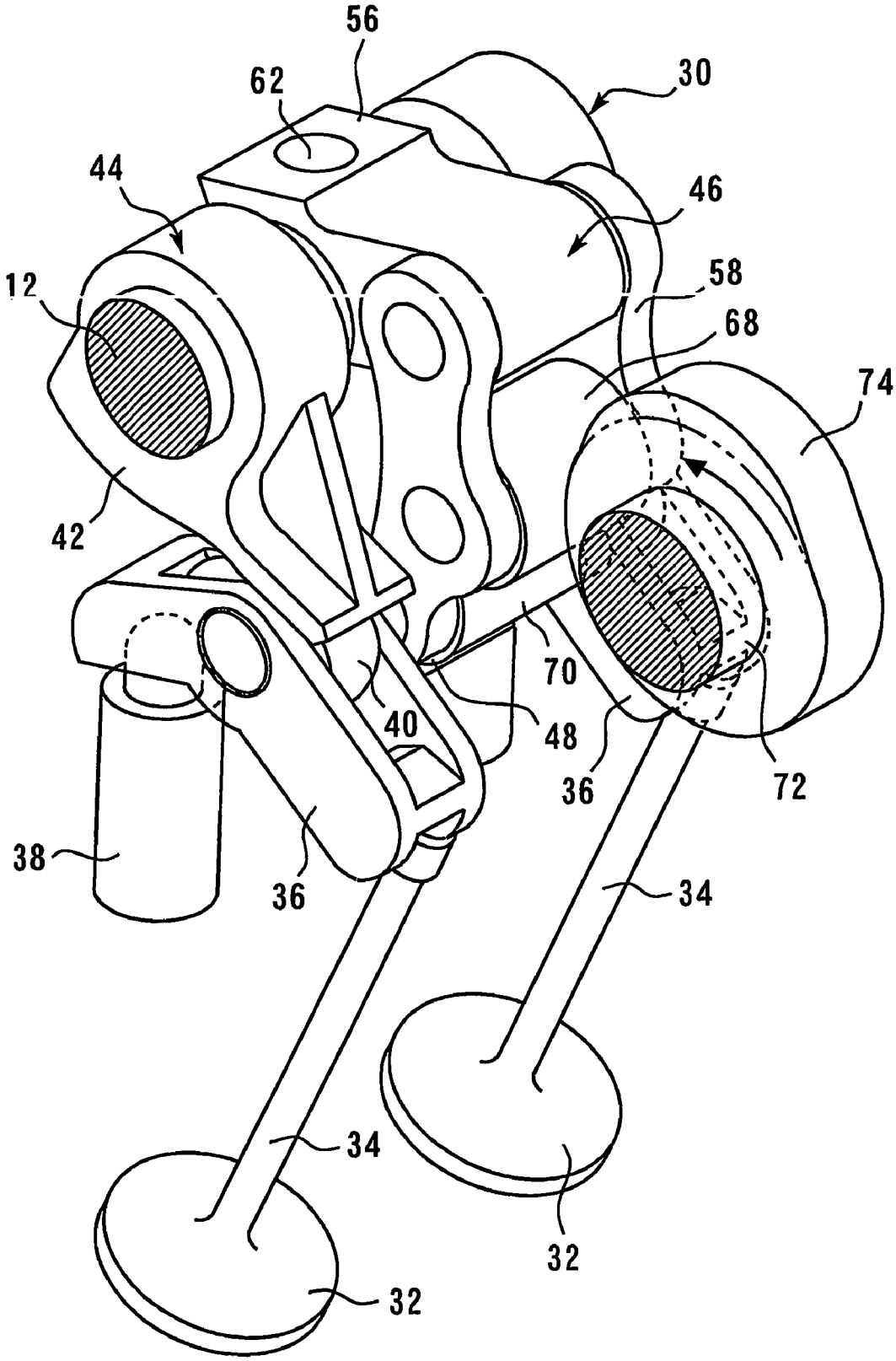
FIG. 2 is a perspective view illustrating a variable valve mechanism that is provided for one cylinder in accordance with the first embodiment of the present invention.

FIG. 2 is an essential part perspective view of the variable valve mechanism 30, which is provided for each cylinder. The variable valve mechanism 30 is equipped with two valve bodies 32 (intake valves) that are to be driven. A valve stem 34 is fastened to each valve body 32. The end of the valve stem 34 is in contact with a pivot that is mounted on one end of a rocker arm 36. A valve spring (not shown in FIG. 2) works on the valve stem 34. The rocker arm 36 is pushed upward by the valve stem 34 on which the valve spring works. The other end of the rocker arm 36 is supported by a hydraulic lash adjuster 38 in a movable state. By means of automatically adjusting the rocker arm's vertical position by hydraulic pressure, the hydraulic lash adjuster 38 automatically adjusts a tappet clearance.

A roller 40 is positioned at the central part of the rocker arm 36. A swinging arm 42 is positioned over the roller 40. The configuration around the swinging arm 42 will now be described with reference to FIG. 3.

Figure 3:
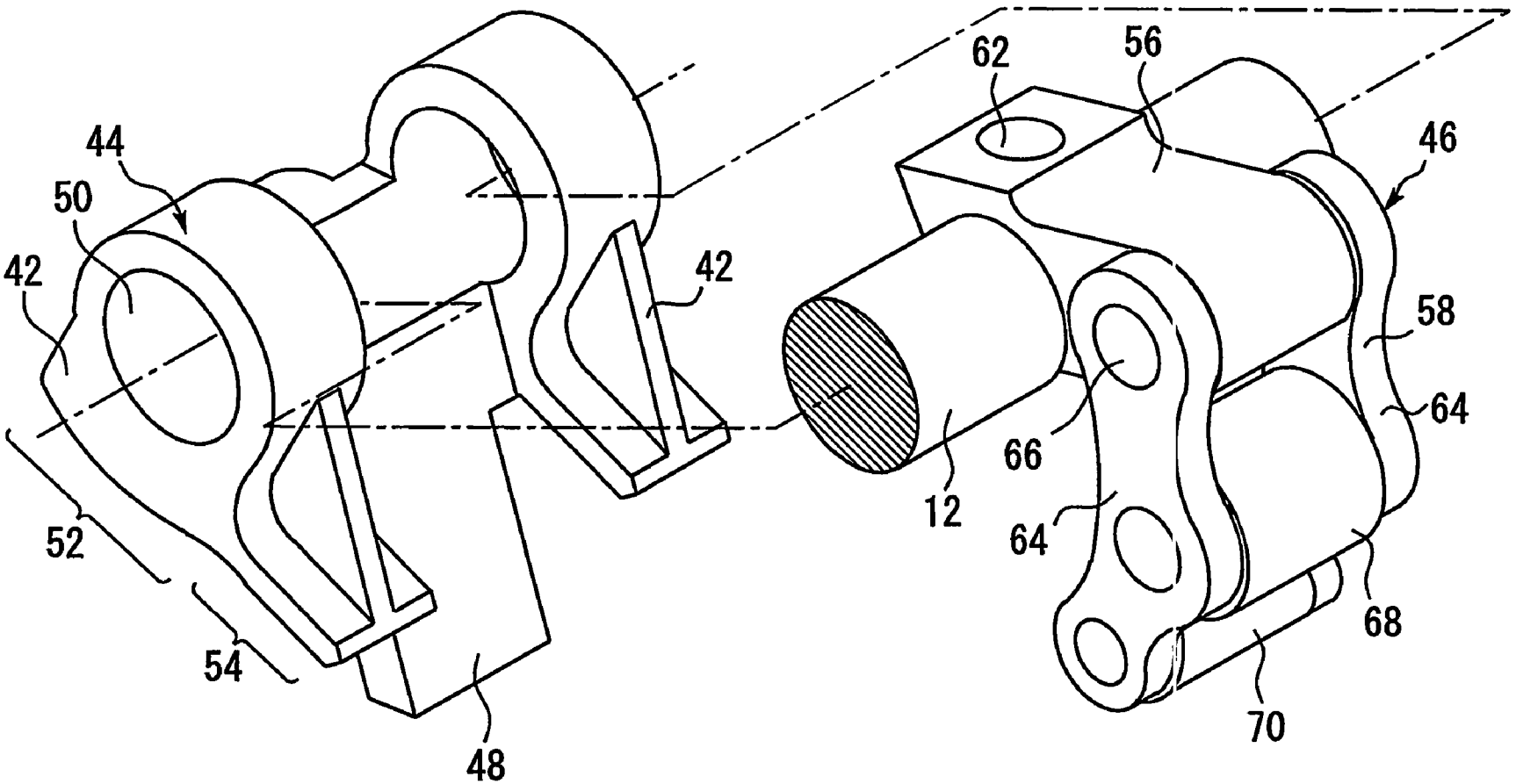
FIG. 3 is an exploded perspective view illustrating a first arm member and a second arm member, which are the components of the variable valve mechanism shown in FIG. 2.

FIG. 3 is an exploded perspective view illustrating a first arm member 44 and a second arm member 46. The first arm member 44 and second arm member 46 are major component members of the variable valve mechanism 30, which is shown in FIG. 2. The aforementioned swinging arm 42 is a part of the first arm member 44.

As shown in FIG. 3, the first arm member 44 incorporates two swinging arms 42 and a roller contact surface 48, which is sandwiched between the two swinging arms 42. The two swinging arms 42 are provided respectively for the two valve bogies 32 and in contact with the aforementioned roller 40 (see FIG. 2).

The first arm member 44 is equipped with a bearing section 50. The bearing sections 50 are provided so as to penetrate the swinging arms, respectively. Each swinging arm 42 has a concentric circular section 52 and a pushing pressure section 54 at a surface that is in contact with the roller 40. The concentric circular section 52 is provided such that the surface in contact with the roller 40 is concentric with the bearing section 50. The pushing pressure section 54 is provided such that the distance between the center of the bearing section 50 and a specific position thereon becomes longer as the specific position becomes closer to its leading end.

The second arm member 46 is equipped with a non-swinging section 56 and a swinging roller section 58. The non-swinging section 56 is provided with a through-hole. The control shaft 12, which is described with reference to FIGS. 1A and 1B, is inserted into the through-hole. Further, a retaining pin 62 is inserted into the non-swinging section 56 and control shaft 12 in order to lock the positional relationship between the non-swinging section 56 and control shaft 12. Therefore, the non-swinging section 56 and control shaft 12 function as a one solid piece.

The swinging roller section 58 is provided with two sidewalls 64. The sidewalls 64 are joined to the non-swinging section 56 via the rotation shaft 66 so that the sidewalls 64 freely turn. A cam contact roller 68 and a slide roller 70 are positioned between the two sidewalls 64. The cam contact roller 68 and slide roller 70 can freely turn while they are sandwiched between the sidewalls 64.

The aforementioned control shaft 12 is retained by the bearing section 50 of the first arm member 44 so that the control shaft 12 can rotate. In other words, the control shaft 12 should be integral with the non-swinging section 56 while it is retained by the bearing section 50. To meet such a requirement, the non-swinging section 56 (that is, the second arm member 46) is positioned between the two swinging arms 42 of the first arm member 44 before being secured to the control shaft 12. While such positioning is achieved, the control shaft 12 is inserted so as to pass through the two bearing sections 50 and non-swinging section 56. Subsequently, the retaining pin 62 is set so as to secure the control shaft 12 and non-swinging section 56. As a result, there is provided a mechanism in which the first arm member 44 can freely turn on the control shaft 12, the non-swinging section 56 is integral with the control shaft 12, and the swinging roller section 58 can swing in relation to the non-swinging section 56.

When the first arm member 44 and second arm member 46 are assembled as described above, the slide roller 70 of the swinging roller section 58 can come into contact with the roller contact surface 48 of the first arm member 44 as long as the relative angle between the first arm member 44 and control shaft 12, that is, the relative angle between the first arm member 44 and non-swinging section 56 is within a range satisfying a predefined condition. When the first arm member 44 turns on the control shaft 12 within the range that satisfies the predefined condition while the slide roller 70 of the swinging roller section 58 is in contact with the roller contact surface 48 of the first arm member 44, the slide roller 70 can roll along the roller contact surface 48. The variable valve mechanism according to the present embodiment opens or closes the valve body 32 while operating with the roll of the slide roller 70. The operation of the valve body 32 will be described in detail later with reference to FIGS. 4A, 4B, 5A, and 5B.

FIG. 2 shows the assembled state that is provided by the first arm member 44, second arm member 46, and control shaft 12 are assembled together by the aforementioned manner. In such an assembled state, the positions of the first arm member 44 and second arm member 46 are regulated by the rotation position of the control shaft 12. As described earlier, the motor 22 is coupled to the control shaft 12 via a gear mechanism (see FIGS. 1A and 1B). In the state shown in FIG. 2, the rotation angle of the control shaft 12 is adjusted by the motor 22 so that the slide roller 70 is brought into contact with the roller contact surface 48.

The variable valve mechanism according to the present embodiment includes a camshaft 72 that rotates in synchronism with a crankshaft. As is the case with the control shaft 12, the camshaft 72 is retained by bearings fastened to the cylinder head 10 so that the camshaft 72 can rotate. A cam 74, which is provided for each internal combustion engine cylinder, is fastened to the camshaft 72. In a state shown in FIG. 2, the cam 74 is in contact with the cam contact roller 68 so that the upward motion of the swinging roller section 58 is regulated. In other words, the roller contact surface 48 of the first arm member 44 is mechanically coupled to the cam 74 via the cam contact roller 68 and slide roller 70 of the swinging roller section 58 in the state shown in FIG. 2.

When a cam nose presses the cam contact roller 68 while the cam 74 rotates in the state described above, the applied pressure is transmitted to the roller contact surface 48 via the slide roller 70. While rolling on the roller contact surface 48, the slide roller 70 can continuously transmit the force of the cam 74 to the first arm member 44. As a result, the first arm member 44 rotates on the control shaft 12, thereby causing the swinging arm 42 to depress the rocker arm 36 and the valve body 32 to move in the valve opening direction. As described above, the variable valve mechanism 30 can operate the valve body 32 by transmitting the force of the cam 74 to the roller contact surface 48 via the cam contact roller 68 and slide roller 70.

[Operation of the Variable Valve Mechanism]

The operation of the variable valve mechanism 30 will now be described with reference to FIGS. 4A, 4B, 5A, and 5B. In FIGS. 4A, 4B, 5A, and 5B, a lost motion spring 76 and a valve spring 78 are shown in addition to the aforementioned components. As described earlier, the valve spring 78 pushes the valve stem 34 and rocker arm 36 in the valve closing direction. The lost motion spring 76, on the other hand, maintains mechanical contact between the roller contact surface 48 and cam 74.

As described above, the variable valve mechanism 30 drives the valve body 32 by mechanically transmitting the force of the cam 74 to the roller contact surface 48. For proper operation of the variable valve mechanism 30, it is therefore necessary that the cam 74 be mechanically coupled to the roller contact surface 48 at all times via the cam contact roller 68 and slide roller 70. To meet this requirement, it is necessary that the roller contact surface 48, that is, the first arm member 44, be pushed toward the cam 74.

The lost motion spring 76 used in the present embodiment is installed so that its upper end is fastened, for instance, to the cylinder head with the lower end positioned to push the rear end of the roller contact surface 48. The pushing force works so that the roller contact surface 48 pushes the slide roller 70 upward. Further, the pushing force also works to press the cam contact roller 68 against the cam 74. As a result, the variable valve mechanism 30 ensures that the cam 74 is mechanically coupled to the roller contact surface 48.

Figure 4B:
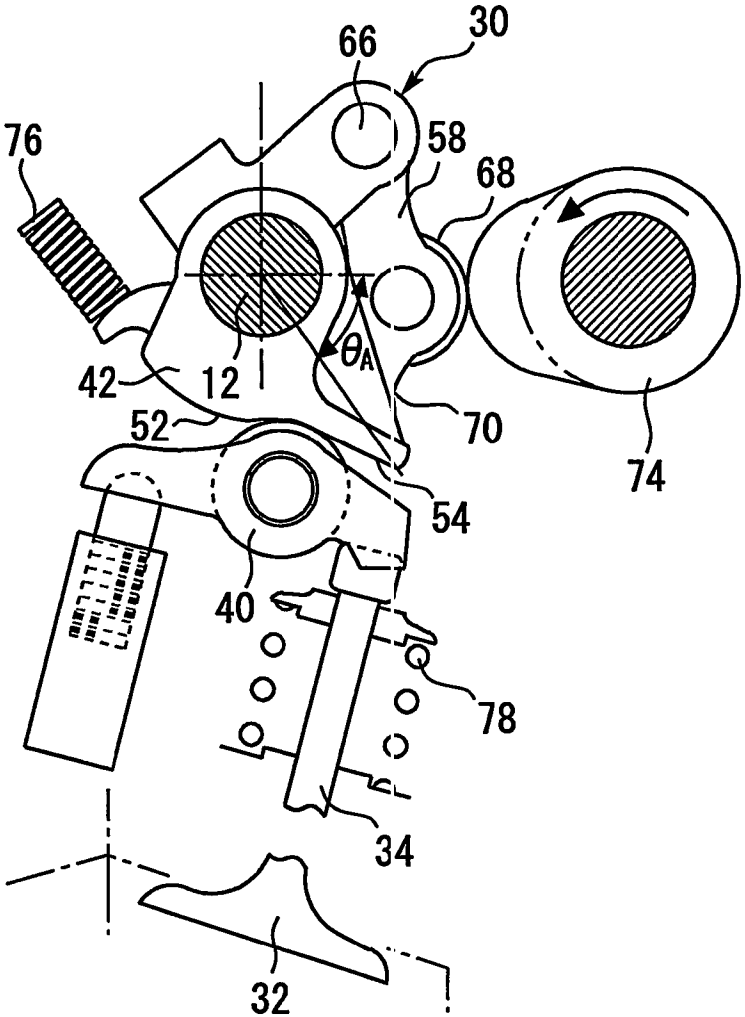
FIGS. 4A and 4B show that the variable valve mechanism according to the first embodiment of the present invention performs a small lift operation.
Figure 4A:
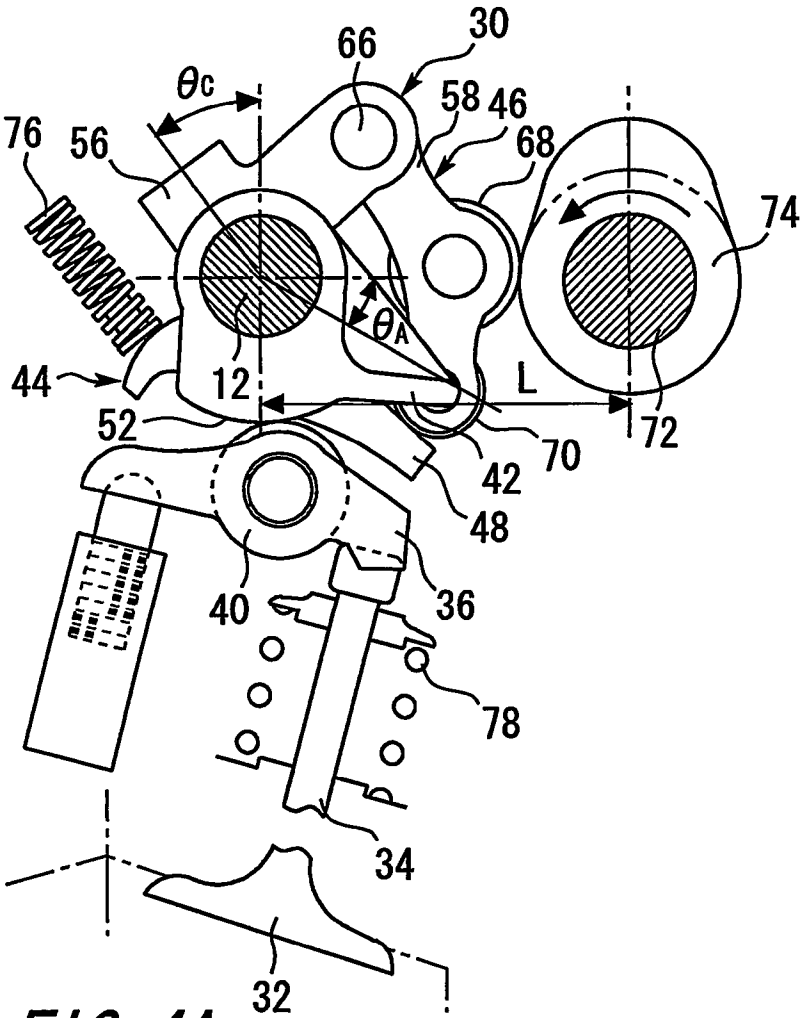

FIGS. 4A and 4B show that the variable valve mechanism 30 operates to give a small lift to the valve body 32. This operation is hereinafter referred to as a "small lift operation". More specifically, FIG. 4A indicates that the valve body 32 is closed during the small lift operation, whereas FIG. 4B indicates that the valve body 32 is open during the small lift operation.

In FIG. 4A, the symbol $\theta_c$ denotes a parameter that indicates the rotation position of the control shaft 12. The parameter is hereinafter referred to as the "control shaft rotation angle $\theta_c$". For the sake of convenience, the control shaft rotation angle $\theta_c$ is defined herein as the angle between the vertical direction and the axial direction of the retaining pin 62 that secures the control shaft 12 and non-swinging section 56. The symbol $\theta_A$ in FIG. 4A denotes a parameter that indicates the rotation position of the swinging arm 42. This parameter is hereinafter referred to as the "arm rotation angle $\theta_A$". For the sake of convenience, the arm rotation angle $\theta_A$ is defined herein as the angle between the horizontal direction and the straight line connecting the leading end of the swinging arm 42 to the center of the control shaft 12.

In the variable valve mechanism 30, the rotation position of the swinging arm 42, that is, the arm rotation angle $\theta_A$, is determined by the position of the slide roller 70. The position of the slide roller 70 is determined by the position of the rotation shaft 66 for the swinging roller section 58 and the position of the cam contact roller 68. Within the range within which the contact between the cam controller roller 68 and cam 74 is maintained, the greater the degree of counterclockwise rotation of the rotation shaft 66 becomes in FIGS. 4A and 4B, that is, the greater the control shaft rotation angle $\theta_c$ is, the higher the position of the slide roller 70 changes. In the variable valve mechanism 30, therefore, the greater the control shaft rotation angle $\theta_c$ is, the smaller the arm rotation angle $\theta_A$ becomes.

In a state shown in FIG. 4A, the control shaft rotation angle $\theta_c$ is maximized within the range within which the cam contact roller 68 can maintain its contact with the cam 74, that is, the cam 74 can regulate the upward movement of the cam contact roller 68. Therefore, the arm rotation angle $\theta_A$ is nearly minimized in the state shown in FIG. 4A. In this instance, the variable valve mechanism 30 is such that the approximate center of the concentric circular section 52 of the swinging arm 42 is in contact with the roller 40 of the rocker arm 36, thereby closing the valve body 32. The arm rotation angle $\theta_A$ prevailing in this instance is hereinafter referred to as the "reference arm rotation angle $\theta_{A0}$ for a small lift".

When the cam 74 rotates in the state shown in FIG. 4A, the cam contact roller 68 moves toward the control shaft 12 as it is pressed by the cam nose. Since the distance between the rotation shaft 66 of the swinging roller section 58 and the slide roller 70 remains unchanged, the roller contact surface 48 is depressed by the slide roller 70, which rolls above the roller contact surface 48, when the cam contact roller 68 approaches the control shaft 12. Consequently, the swinging arm 42 rotates in such a direction as to increase the arm rotation angle $\theta_A$. As a result, the contact point between the swinging arm 42 and roller 40 leaves the approximate center of the concentric circular section 52 and moves toward the pushing pressure section 54.

When the pushing pressure section 54 comes into contact with the roller 40 due to the rotation of the swinging arm 42, the valve body 32 moves in the valve opening direction in spite of the force applied by the valve spring 78. When the vertex of the cam nose comes into contact with the cam contact roller 68 as shown in FIG. 4B, the arm rotation angle $\theta_A$ becomes maximized (this angle is hereinafter referred to as the "maximum arm rotation angle $\theta_{AMAX}$). Consequently, the lift amount for the valve body 32 reaches its maximum. Subsequently, with the rotation of cam 74, the arm rotation angle $\theta_A$ decreases, thereby the lift amount for the valve body 32 decreases. When the contact point between the roller 40 and swinging arm 42 returns to the concentric circular section 52, the valve body 32 closes.

Since the reference arm rotation angle $\theta_{A0}$ for a small lift operation is small, the valve body 32 remains closed for a certain period of time after the cam nose begins to come into contact with the cam contact roller 68. After the maximum lift amount is generated, the valve body 32 reverts to a closed state relatively early before the end of cam nose pressure application to the cam contact roller 68. As a result, when a small lift operation is performed, the time in which the valve body 32 is in a non-closed state is small, that is, the operating angle of the valve body 32 is small. As well, the maximum lift amount for the valve body 32 is small in this case.

Figure 5B:
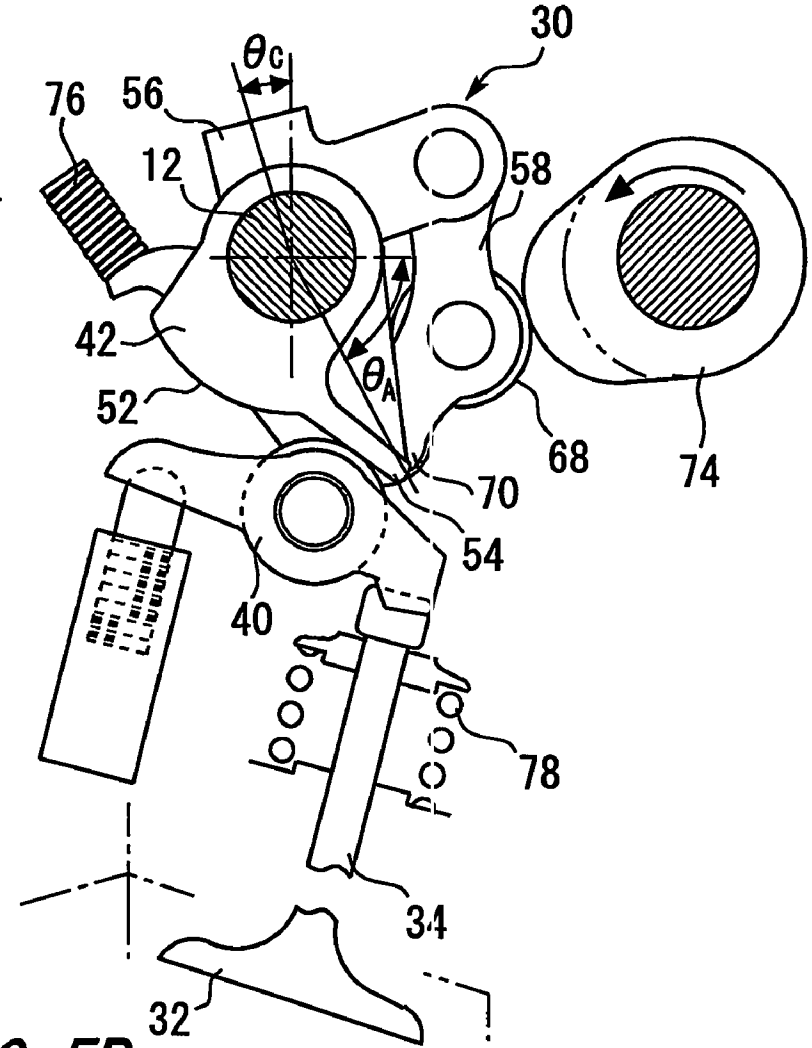
FIGS. 5A and 5B show that the variable valve mechanism according to the first embodiment of the present invention performs a great lift operation.
Figure 5A:
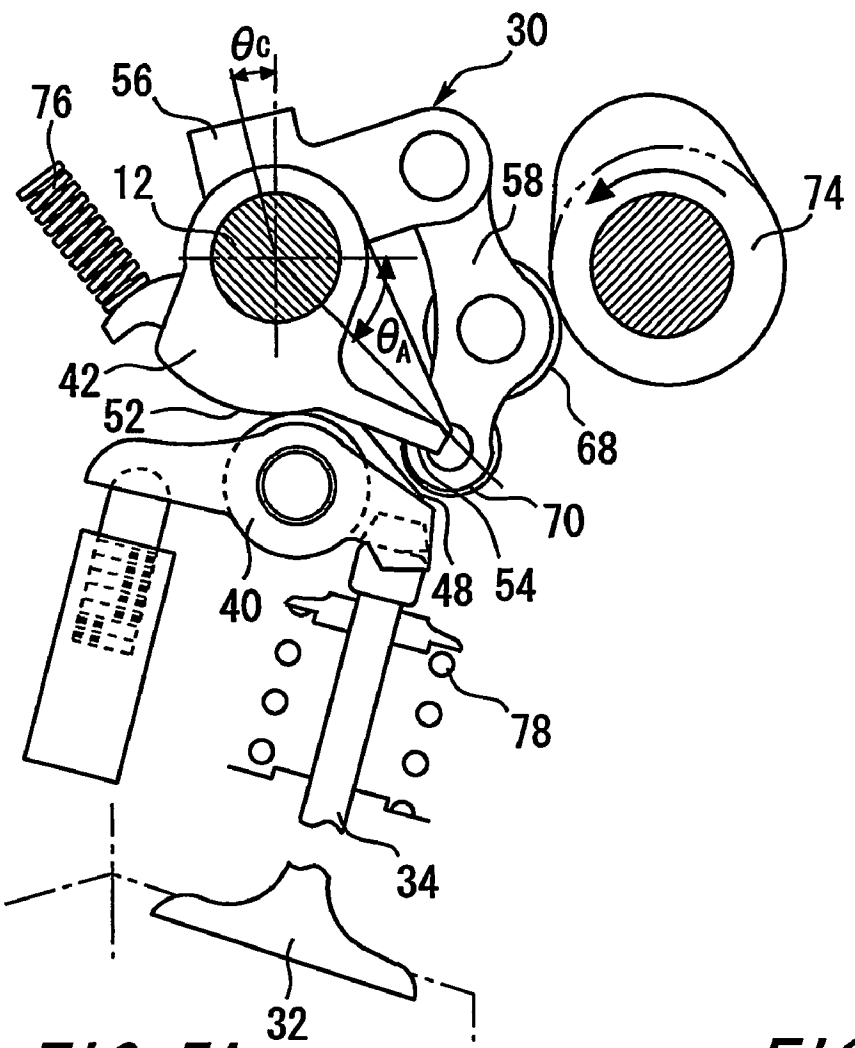

FIGS. 5A and 5B indicate that the variable valve mechanism 30 operates to give a great lift to the valve body 32. This operation is hereinafter referred to as a "great lift operation". More specifically, FIG. 5A indicates that the valve body 32 is closed during a great lift operation, whereas FIG. 5B indicates that the valve body 32 is open during a great lift operation.

When a great lift operation is to be performed, the control shaft rotation angle $\theta_c$ is adjusted to a sufficiently small value as shown in FIG. 5A. As a result, the arm rotation angle $\theta_A$ for anon-lift state, that is, the reference arm rotation angle $\theta_{A0}$, is set to a sufficiently great value to such an extent that the slide roller 70 does not fall away from the roller contact section 28. The variable valve mechanism 30 is configured so that the contact point between the swinging arm 42 and roller 40 is positioned at the end of the concentric circular section 52 at the above reference arm rotation angle $\theta_{A0}$. In such a situation, therefore, the valve body 32 remains closed.

When the cam 74 rotates in a state shown in FIG. 5A, the contact point between the roller 40 and swinging arm 42 moves from the concentric circular section 52 to the pushing pressure section 54 immediately after the cam contact roller 68 begins to be pressed by the cam nose. The valve body 32 is then greatly pushed in the valve opening direction until the cam contact roller 68 is pressed by the peak section of the can nose. Even after the lift amount for the valve body 32 is maximized as shown in FIG. 5B, the valve body 32 remains open for a long period of time as far as the cam contact roller 68 is pressed by the cam nose. Therefore, while the great lift operation is being performed as described above, the variable valve mechanism 30 can provide the valve body 32 with a great operating angle and large lift amount.

[Problems with the Variable Valve Mechanism According to the Present Embodiment]

As described earlier, the variable valve mechanism according to the present embodiment can change the operating angle and lift amount of the valve body 32 by rotating the control shaft 12. In the present embodiment, the control shaft 12 and camshaft 72 are both retained by the cylinder head 10. In FIG. 4A, distance L represents the dimension between the control shaft 12 and camshaft 72. Distance L changes when the cylinder head 10 thermally deforms due to a temperature change in the area around the cylinder head 10. When a temperature change occurs in the area around the cylinder head 10, the members positioned between the control shaft 12 and camshaft 72, namely, the first arm member 44 and second arm member 46, are subject to thermal expansion or shrinkage.

The cylinder head 10 according to the present embodiment is made of an aluminum-based material. On the other hand, the first arm member 44 and second arm member 46 are made of an iron-based material. These materials exhibit different linear expansion coefficients. Therefore, if the ambient temperature of the cylinder head 10 changes, the resulting status is the same as that is invoked by a change in distance L.

More specifically, if the temperature is increased, distance L increases to a greater extent than the expansion of the first arm member 44 and second arm member 46, and the reference arm rotation angle $\theta_{A0}$ decreases, thereby decreasing the actual operating angle. If, on the contrary, the temperature prevailing in the area around the cylinder head 10 is decreased, distance L decreases to a greater extent that the shrinkage of the first arm member 44 and second arm member 46, and the reference arm rotation angle $\theta_{A0}$ increases, thereby increasing the actual operating angle.

Figure 6:
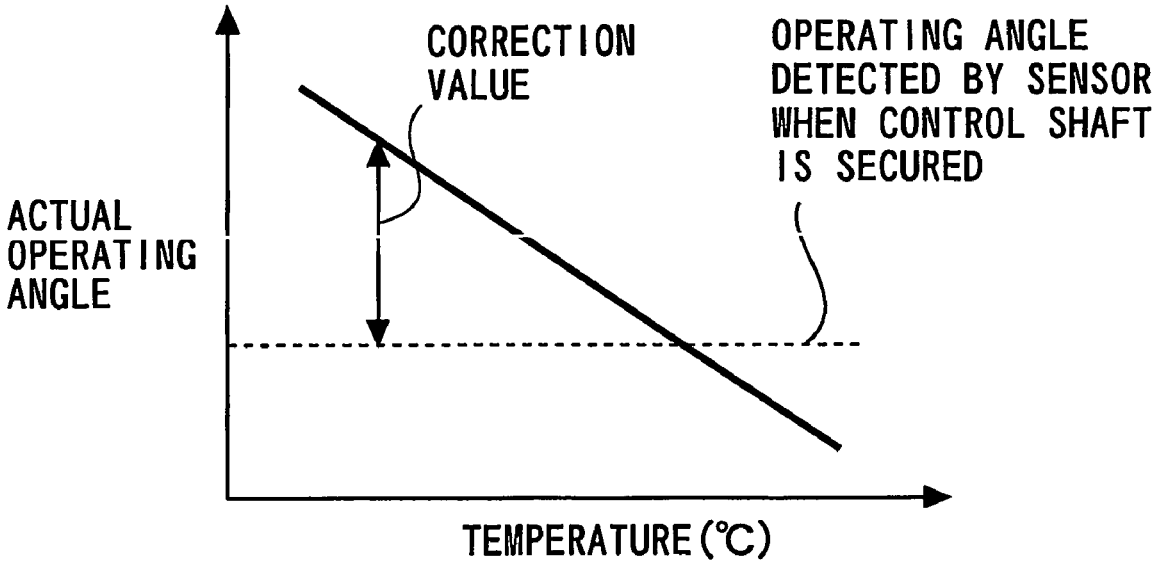
FIG. 6 illustrates the actual operating angle-temperature relationship that arises in the variable valve mechanism according to the first embodiment of the present invention.

FIG. 6 illustrates the actual operating angle's temperature characteristic that is based on the linear expansion coefficient difference between the member determining distance L and the member positioned between the control shaft 12 and cam 74. The actual operating angle indicated by a broken line in FIG. 6 is an operating angle that is calculated by substituting the output of the rotation angle sensor 26 into a reference arithmetic expression. In other words, it is an actual operating angle that is provided at a reference temperature for setting up the reference arithmetic expression. This operating angle is hereinafter referred to as the "detected operating angle".

If the ECU 28 calculates the operating angle of the valve body 32 by constantly substituting the output of the rotation angle sensor 26 into the reference arithmetic expression, the resulting calculated detected operating angle is smaller than the actual operating angle in a low-temperature region and greater than the actual operating angle in a high-temperature region as shown in FIG. 6. Therefore, if such a calculation method is used, a desired operating angle or lift amount cannot accurately be obtained even when control is exercised with the control shaft rotation angle $\theta_c$ set as a target value. If, in a throttle-less internal combustion engine, the intake valve's operating angle or lift amount deviates from a desired value, the intake air amount control accuracy is adversely affected.

The deviation between the actual operating angle and detected operating angle is a value that is determined primarily by the ambient temperature of the cylinder head 10. Therefore, when the ambient temperature is determined, it is possible to estimate the deviation between the actual operating angle and detected operating angle. As such being the case, the variable valve mechanism according to the present embodiment estimates the ambient temperature of the cylinder head 10 in accordance with the output of the water temperature sensor 29 (cooling water temperature THW), and calculates the deviation, which will possibly arise between the detected operating angle and actual operating angle, in accordance with the estimated ambient temperature. Further, the variable valve mechanism according to the present embodiment calculates the actual operating angle by adding the calculated deviation to the detected operating angle as a correction value.

Figure 7:
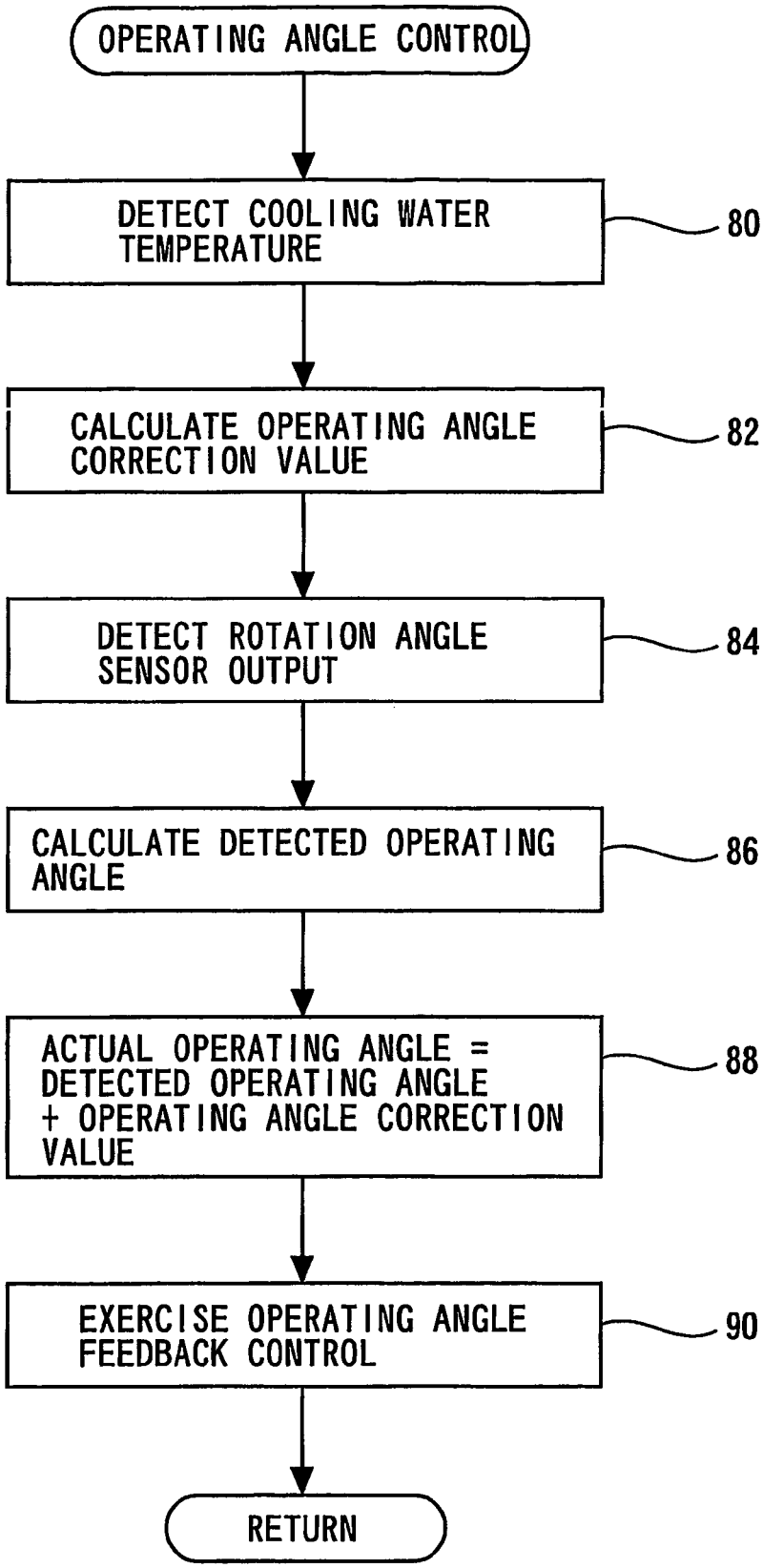
FIG. 7 is a flowchart illustrating a routine that is executed in accordance with the first embodiment of the present invention.

FIG. 7 is a flowchart illustrating a routine that the ECU 28 executes in accordance with the present embodiment, which implements the above functionality. The routine shown in FIG. 7 first detects the cooling water temperature THW of the internal combustion engine in accordance with the output of the water temperature sensor 29 (step 80). The present embodiment handles the detected cooling water temperature THW as the ambient temperature of the cylinder head 10.

Next, step 82 is performed to calculate the correction value for the operating angle. The ECU 28 stores a map, which defines the relationship between the ambient temperature of the cylinder head 10 and the deviation $\Delta\theta$ between the actual operating angle and detected operating angle ($\Delta\theta$= actual operating angle−detected operating angle), that is, the value indicated as the correction value" in FIG. 6. In step 82, the map is referenced to calculate the deviation $\Delta\theta$ for the current temperature. The calculated deviation $\Delta\theta$ is then handled as the operating angle correction value.

Next, step 84 is performed to detect the output of the rotation angle sensor 26. Step 86 is then performed to calculate the detected operating angle in accordance with the detected sensor output. The ECU 28 stores the reference arithmetic expression for converting the output of the rotation angle sensor 26 to the detected operating angle. In step 86, the detected operating angle is calculated in accordance with the stored reference arithmetic expression. According to the process performed in step 86, it is possible to calculate an operating angle that is indicated by a broken line in FIG. 6, that is, the actual operating angle that occurs at the reference temperature.

Next, step 88 is performed to calculate the actual operating angle by adding the operating angle correction value to the detected operating angle that has been calculated as described above. The process performed in step 88 calculates the actual operating angle that is indicated by a solid line in FIG. 6.

Subsequently to the above process, the ECU 28 exercises feedback control so that the operating angle of the valve body 32 is handled as a target operating angle (step 90). More specifically, the control value for the motor 22 is controlled so that the actual operating angle calculated in step 88 above accords with the target operating angle calculated by another routine in accordance, for instance, with the required intake air amount.

The above process makes it possible to avoid the influence of a temperature change in the area around the cylinder head 10 and calculate the actual operating angle provided by the valve body 32 accurately at all times. Further, the operating angle and lift amount of the valve body 32 can be accurately controlled by controlling the control value for the motor 22 on the basis of the accurate actual operating angle. Therefore, the variable valve mechanism according to the present embodiment can control the valve opening characteristic of the intake valve accurately at all times and constantly provide a throttleless internal combustion engine with an excellent operating characteristic without regard to the internal combustion engine warm-up status or environmental conditions.

Strictly speaking, in the variable valve mechanism according to the present embodiment, the relationship between the temperature and the deviation $\Delta\theta$ between the actual operating angle and detected operating angle may vary with the actual operating angle. It is therefore difficult to provide a precise operating angle correction for all operating angles depending on the deviation $\Delta\theta$-temperature map stored in the ECU 28.

Under these circumstances, the present embodiment prepares a deviation $\Delta\theta$-temperature map for a situation where the smallest operating angle is required for the valve body 32, that is, where a small lift operation is performed as described with reference to FIGS. 4A and 4B. According to the prepared map, it is possible to provide corrections with adequate accuracy in a region where the operating angle and lift amount are small although the required operating angle correction accuracy decreases in a region where the required operating angle and lift amount are large.

In a region where the operating angle and lift amount are small, a slight error in the operating angle incurs a great error in the intake air amount. In a region where the operating angle and lift amount are large, on the other hand, a certain error in the operating angle does not incur a significant error in the intake air amount. Therefore, the use of a deviation $\Delta\theta$-temperature map for a small lift operation makes it possible to control the intake air amount with adequate accuracy in all operating angle regions although it lowers the operating angle correction accuracy in a great lift region.

To attain high correction accuracy for all operating angles, an alternative is to prepare a map in which the deviation $\Delta\theta$ between the actual operating angle and detected operating angle are defined based on temperature and operating angle, and reference the map in step 82 to calculate the deviation $\Delta\theta$, that is, the operating angle correction value $\Delta\theta$. When this method is used, excellent operating angle/lift amount control can be exercised in all operating angle regions although an increased computation load is imposed on the ECU 28.

The first embodiment, which has been described above, corrects the detected operating angle in accordance with the ambient temperature of the cylinder head 10 to obtain the actual operating angle and then accordingly corrects the control value to be supplied to the motor 22. However, the correction target is not limited to the operating angle or the control value for the motor 22. More specifically, the target operating angle, which is the target for the actual operating angle in feedback control, may be targeted for correction. The routine shown in FIG. 7 may calculate a correction value for the target operating angle in step 82, calculate a corrected target operating angle in step 88, and control the motor 22 so that the detected operating angle coincides with the corrected target operating. angle.

The first embodiment, which has been described above, avoids the influence of an intake valve characteristic change arising out of a temperature change by correcting the operating angle. However, an alternative method may be used to avoid such influence. For example, in anticipation that the operating angle will change in accordance with a temperature change, the fuel injection amount for each cylinder may be corrected so as to obtain a desired air-fuel ratio in relation to an intake air amount that is provided by the resulting operating angle.

The first embodiment, which has been described above, has a configuration that changes the operating angle and lift amount of the valve body 32 by rotating the control shaft 12. However, the present invention is not limited to the use of such a method. Alternatively, the operating angle and lift amount of the valve body 32 may be changed by sliding the control shaft.

In the first embodiment, which has been described above, the variable valve mechanism 30 changes both the operating angle and lift amount in accordance with the status of the control shaft 12. However, the present invention is not limited to the use of such a method. Alternatively, the variable valve mechanism may change either the operating angle or lift amount. If such an alternative method is used, the correction for avoiding the influence of temperature may be made while focusing attention on either the operating angle or lift amount, whichever is about to change.

In the first embodiment, which has been described above, the first arm member 44 and second arm member 46 correspond to the "adjustment mechanism" according to the aforementioned first aspect of the present invention. The water temperature sensor 29 corresponds to the "temperature detection unit" according to the first aspect of the present invention. The "temperature correction unit" according to the first aspect of the present invention is implemented when the ECU 28 performs processing steps 80 through 90.

In the first embodiment, which has been described above, the rotation angle sensor 26 corresponds to the "sensor" according to the aforementioned second aspect of the present invention. The motor 22 corresponds to the "actuator" according to the second aspect of the present invention. The "actuator control unit" and "temperature correction unit" according to the second or third aspect of the present invention are implemented when the ECU 28 performs processing step 90.

In the first embodiment, which has been described above, the rotation angle sensor 26 corresponds to the "sensor" according to the aforementioned fourth aspect of the present invention. The motor 22 corresponds to the "actuator" according to the fourth aspect of the present invention. The "target status setup unit" according to the fourth aspect of the present invention is implemented when the ECU 28 sets a target operating angle for feedback control. The "temperature correction unit" according to the fourth aspect of the present invention is implemented when the ECU 28 corrects the target operating angle in accordance with temperature. The "actuator control unit" according to the fourth aspect of the present invention is implemented when the ECU 28 exercises feedback control over the motor 22 with the corrected target operating angle set as a control target.

Second Embodiment

A second embodiment of the present invention will now be described with reference to FIGS. 1A through 5B. The variable valve mechanism according to the second embodiment has the same structure as the variable valve mechanism according to the first embodiment. As regards the mechanism according to the first embodiment, the member for determining the distance between the control shaft 12 and camshaft 72, that is, distance L shown in FIG. 4A, and the member positioned between the control shaft 12 and camshaft 72 are made of materials having different linear expansion coefficients, and the operating angle is corrected in accordance with the ambient temperature of the cylinder head 10 to avoid the influence of thermal expansion and thermal shrinkage.

As regards the variable valve mechanism according to the second embodiment, however, the members for determining distance L (that is, the cylinder head 10) and the member positioned between the control shaft 12 and camshaft 72 (namely, the first arm member 44 and second arm member 46) are made of materials having the same linear expansion coefficient in order to avoid the influence of thermal expansion and thermal shrinkage. This configuration can be achieved when, for instance, the cylinder head 10 is made of an iron-based material as is the case with the first arm member 44 and second arm member 46.

If the cylinder head 10, first arm member 44, and second arm member 46 are made of materials having the same linear expansion coefficient, the same expansion/shrinkage occurs in a mechanism between the control shaft 12 and camshaft 72 as for distance L when distance L expands or shrinks due to a temperature change. Even if the ambient temperature of the cylinder head 10 changes in the above instance, the basic arm rotation angle $\theta_{A0}$ remains unchanged. Therefore, the relationship between the operating angle of the valve body 32 and the control shaft rotation angle $\theta_c$ does not change. As a result, the variable valve mechanism according to the present embodiment can constantly provide the valve body 32 with a desired valve opening characteristic without being affected by a temperature change and without having, for instance, to correct the operating angle.

In the second embodiment, which has been described above, the first arm member 44 and second arm member 46 correspond to the "adjustment mechanism" and the "member positioned between the control shaft and cam" according to the aforementioned fifth aspect of the present invention. The cylinder head 10 corresponds to the "member for determining the distance between the control shaft and cam" according to the fifth aspect of the present invention.

Third Embodiment

A third embodiment of the present invention will now be described with reference to FIGS. 8 through 10. The variable valve mechanism according to the third embodiment has the same structure as the variable valve mechanism according to the first embodiment.

[Problems with the Variable Valve Mechanism according to the Present Embodiment]

It is necessary that the operating angle and lift amount for properly operating the internal combustion engine be properly set in accordance with the internal combustion engine's operating status. More specifically, it is necessary that the operating angle and lift amount suitable for startup be set at the time of internal combustion engine startup. When the internal combustion engine is stopped, however, the operating angle and lift amount may not always be set as appropriate for internal combustion engine startup. For an internal combustion engine equipped with a variable valve mechanism, therefore, it is necessary that the operating angle and lift amount be corrected during the time interval between the instant at which an internal combustion engine stop is requested and the instant at which the internal combustion engine restarts.

The conventional variable valve mechanism shown in Japanese Patent Laid-Open No. 63023/1995 discussed above can correct the valve body's operating angle and lift amount by rotating the control shaft. Therefore, an excellent startup characteristic can be obtained as far as an internal combustion engine startup sequence is initiated after adjusting the control shaft rotation position in compliance with a request for internal combustion engine startup to provide the operating angle and lift amount suitable for startup.

To adjust the control shaft rotation position, however, it is necessary to detect it. Further, the relationship between the output of an employed sensor, which is necessary for control shaft rotation position detection, and the actual rotation position may vary with the individual specificities of the sensor and variable valve mechanism or with their changes with time. To properly adjust the control shaft rotation position at internal combustion engine startup, therefore, it is necessary to use a sensor output whose correlation with the control shaft status is properly corrected.

The relationship between the control shaft rotation position and the sensor output for control shaft rotation position detection can be calibrated, for instance, by rotating the control shaft until it reaches its movement end and reading the resulting sensor output. When the internal combustion engine starts up, however, the sensor output cannot be calibrated in the above manner due to time limitations. Therefore, an appropriate method for satisfying the above requirements would be to calibrate the sensor output after internal combustion engine startup, detect the sensor output at the time when an internal combustion engine stop is requested as a value prevailing control shaft rotation position (or valve body operating angle or lift amount) of the time, and adjust the control shaft for startup on the basis of the detected sensor output.

However, the variable valve mechanism is usually subjected to a significant change in ambient temperature after an internal combustion engine stop. Therefore, the parts around the control shaft and camshaft are likely to suffer significant thermal deformation after an internal combustion engine stop. If such thermal deformation occurs in the variable valve mechanism, a status change occurs in the swinging arm, which is positioned between the control shaft and cam, and in the adjustment mechanism for changing the swinging arm angle.

More specifically, in the conventional variable valve mechanism described above, when the ambient temperature of the control shaft lowers, the spacing interval between the control shaft and camshaft decreases, thereby the status of the swinging arm is changed in the direction of increasing the operating angle and lift amount. If, on the other hand, the ambient temperature of the control shaft rises, the spacing interval between the control shaft and camshaft increases, thereby changing the status of the swinging arm in the direction of decreasing the operating angle and lift amount. Therefore, regarding an internal combustion engine equipped with a variable valve mechanism, even if the sensor output is acquired at a time of an engine stop and the control shaft is adjusted for startup on the basis of the acquired sensor output, it becomes that the control shaft status prevailing at startup is shifted from an optimum operating angle/lift amount generation state by the amount due to a temperature change encountered after the internal combustion engine stop.

The variable valve mechanism according to the present embodiment has been made to solve the above problems. It is an object of the present embodiment to provide a variable valve mechanism that is capable of constantly providing the valve body with an optimum valve opening characteristic at internal combustion engine startup without being affected by a temperature change that occurs after an internal combustion engine stop.

Same as in the first embodiment, the variable valve mechanism according to the present embodiment can change the operating angle and lift amount of the valve body 32 by rotating the control shaft 12. When the operating angle and lift amount are optimized, the internal combustion engine according to the present embodiment can obtain a desired intake air amount and a desired operating state.

To properly start up the internal combustion engine, it is necessary to provide the valve body 32 with an operating angle and lift amount suitable for startup at the time of startup. Since it is demanded that the internal combustion engine exhibit excellent startability within the entire assumable operating temperature range, it is necessary that the operating angle and lift amount be set at internal combustion engine startup so as to obtain excellent startability under the most severe conditions. The present embodiment assumes that the lower limit of the operating temperature range for the internal combustion engine is −35° C. Therefore, the operating angle and lift amount for startup should be controlled so that the internal combustion engine properly starts up in an environment where the temperature is −35° C. The operating angle range that meets the above requirement is hereinafter referred to as the "operating angle range required for extremely cold startup".

While the internal combustion engine is running, the operating angle appropriate for the operating state is constantly achieved. When a request for stopping the internal combustion engine is generated, therefore, the operating angle is usually outside the operating angle range required for extremely cold startup. To start up the internal combustion engine with the operating angle maintained within the operating angle range required for extremely cold startup, it is necessary to correct the rotation position of the control shaft 12 so that the operating angle falls within the operating angle range required for extremely cold startup during the time interval between the instant at which an internal combustion engine stop is requested and the instant at which the actual startup sequence is initiated.

As described earlier, the variable valve mechanism according to the present embodiment includes the rotation angle sensor 26, which detects the rotation position of the control shaft 12. Therefore, the ECU 28 can properly correct the rotation position of the control shaft 12 by controlling the motor 22 while observing the output of the rotation angle sensor 26. However, the relationship between the output of the rotation angle sensor 26 and the actual operating angle is not always absolute but is affected, for instance, by changes over time. Therefore, when the rotation position of the control shaft 12 is to be adjusted at internal combustion engine startup, it is preferred that the motor 22 be controlled on the basis of the sensor output whose correlation with the actual operating angle is assured. As viewed from the time of internal combustion engine startup, the last time the relationship between the output of the rotation angle sensor 26 and the actual operating angle is assured is the last internal combustion engine stop. Therefore, for adjusting the rotation position of the control shaft 12 in preparation for internal combustion engine startup, it is proper to detect the output of the rotation angle sensor 26 (that is, the operating angle) at the time of the internal combustion engine stop and use the detected output as a base data of the adjustment.

However, it is common that the ambient temperature of the variable valve mechanism 30 greatly changes after an internal combustion engine stop. Therefore, the section around the control shaft 12 and camshaft 72 is likely to suffer significant thermal deformation after an internal combustion engine stop. If such thermal deformation occurs, the relationship between the output of the rotation angle sensor 26 and the actual operating angle of the valve body 32 changes.

As described above, distance L shown in FIG. 4A represents the dimension between the control shaft 12 and camshaft 72. Distance L decreases when the ambient temperature of the cylinder head 10 lowers after an internal combustion engine stop. During a process during which the ambient temperature of the cylinder head 10 lowers, the members positioned between the control shaft 12 and camshaft 72, namely, the first arm member 44 and second arm member 46, are subject to thermal shrinkage.

The cylinder head 10 according to the present embodiment is made of an aluminum-based material. On the other hand, the first arm member 44 and second arm member 46 are made of an iron-based material. These materials exhibit different linear expansion coefficients. Therefore, when the ambient temperature of the cylinder head 10 lowers, distance L decreases to a greater extent than the first arm member 44 and second arm member 46 do.

In other words, when the ambient temperature of the cylinder head 10 lowers after an internal combustion engine stop within the variable valve mechanism 30 according to the present embodiment, the resulting phenomenon is such that distance L is substantially decreased. As a result, the swinging arm 42 rotates in the direction of increasing the arm rotation angle $\theta_A$ so that the actual operating angle of the valve body 12 increases.

Figure 8:
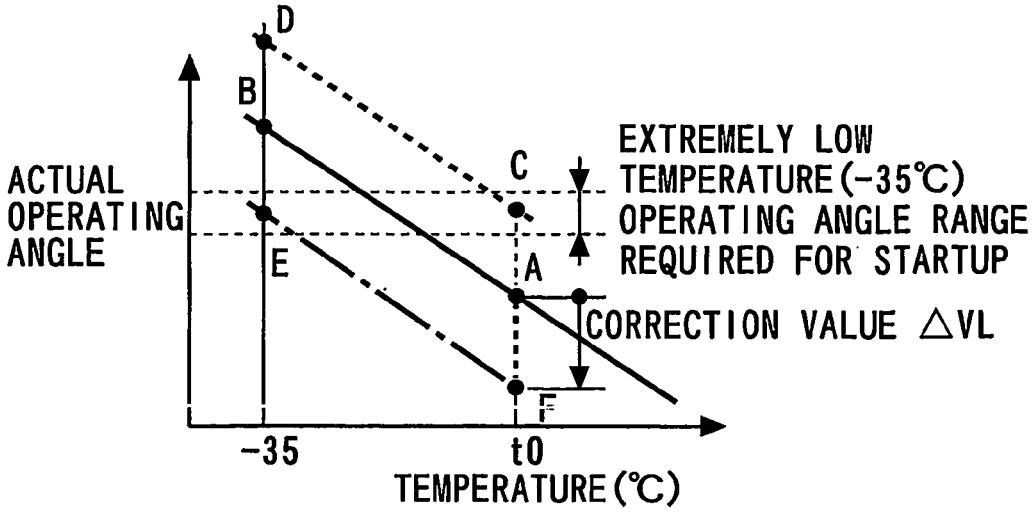
FIG. 8 is a characteristic diagram illustrating the operation of the variable valve mechanism according to a third embodiment of the present invention.

FIG. 8 shows the relationship between a decrease in the internal combustion engine temperature and the actual operating angle change in the valve body 32. In FIG. 8, point A corresponds to temperature t0 and actual operating angle A. Temperature t0 is the ambient temperature of the variable valve mechanism 30 during an internal combustion engine operation. A solid straight line passing through point A in FIG. 8 indicates the temperature/actual operating angle relationship that prevails after the rotation position of the control shaft 12 is fixed at point A. It indicates that the temperature/actual operating angle relationship shifts from point A to point B if the internal combustion engine temperature drops to the lowest temperature within the operating temperature range (it is assumed herein that the lowest temperature is −35° C.) while the control shaft 12 remains at a fixed position after the internal combustion engine is stopped at temperature t0 and at actual operating angle A.

The "operating angle range required for extremely cold startup", which is indicated by two horizontal broken lines in FIG. 8, represents an optimum operating angle range for properly starting the internal combustion engine at an ambient temperature as low as 35° C. To properly start up the internal combustion engine within the operating temperature range at all times, it is preferred that an internal combustion engine startup process (cranking) start while the actual operating angle of the valve body 32 is within its "operating angle range required for extremely cold startup". If, for instance, the temperature/actual operating angle relationship corresponds to point B in FIG. 8, it is preferred that cranking starts after the rotation position of the control shaft 12 is adjusted so that actual operating angle B is within the operating angle range required for extremely cold startup.

However, while the temperature/actual operating angle relationship shifts from point A to point B, the rotation position of the control shaft 12 remains unchanged. Therefore, even when the actual operating angle changes from A to B after an internal combustion engine stop, the output of the rotation angle sensor 26 does not change as far as the actual operating angle change is solely due to a temperature change. In this instance, if the actual operating angle is recognized on the basis of the output of the rotation angle sensor 28 only, the operating angle is erroneously recognized as A although it should be recognized as B when the internal combustion engine restarts at an extremely low temperature (−35° C.).

If, in reality, the operating angle is A, the actual operating angle can be set at value C, which is within the operating angle range required for extremely cold startup, when the rotation position of the control shaft 12 is adjusted to increase the operating angle by the amount of difference between the value A and the operating angle range required for extremely cold startup. However, if the same adjustment is made while assuming that the actual operating angle value is A in a situation where the actual operating angle is B, the resulting actual operating angle is represented by the value D, which is greater than the value B by the amount equal to C minus A (see the non-horizontal broken line in FIG. 6).

Meanwhile, the dependence of the actual operating angle on the temperature can be experimentally determined. Therefore, if temperature t0, which prevails at the time of an internal combustion engine stop, is known, the amount of change in the actual operating. angle (B-A), which occurs during a process during which the internal combustion engine temperature lowers to an extremely low temperature (−35° C.), can be determined as a function of the amount of a temperature change (t0−(−35)). When actual operating angle A, which prevails during an internal combustion engine stop, and its change amount (B-A) are both known, they can be added together to determine actual operating angle B, which prevails at the extremely low temperature and is implemented while the control shaft 12 is fixed. When actual operating angle B is determined, it is possible to calculate a correction value ΔVL for converting the value B to the value E, which falls within the operating angle range required for extremely cold startup.

When the control shaft 12 is adjusted at the time of an internal combustion engine stop so that actual operating angle A changes to the value F, which is smaller by ΔVL, a situation can be generated in which actual operating angle E is within the operating angle range required for extremely cold startup if the internal combustion engine temperature becomes extremely low (−35° C.) in a subsequent process. In such an instance, the internal combustion engine can be properly restarted at an extremely low temperature simply by initiating a cranking sequence without having to adjust the rotation position of the control shaft 12. In the present embodiment, therefore, the ECU 28 detects actual operating angle A (the output of. the rotation angle sensor 26) and temperature t0 (the output of the water temperature sensor 29) at the time of an internal combustion engine stop, calculates the correction value ΔVL in accordance with the detected values, and adjusts the rotation position of the control shaft 12 so that the correction value ΔVL is reflected in the operating angle.

Figure 9:
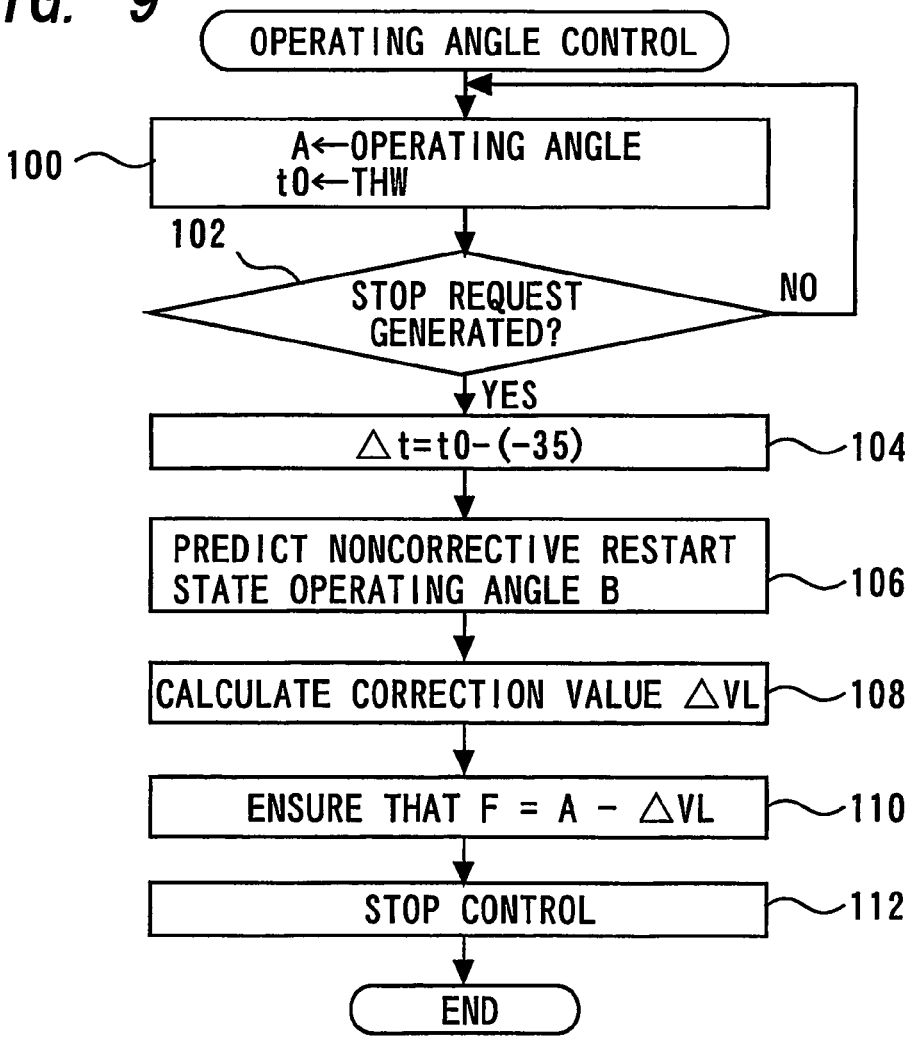
FIG. 9 is a flowchart illustrating a routine that is executed in the variable valve mechanism accordance with the third embodiment of the present invention.
Figure 10:
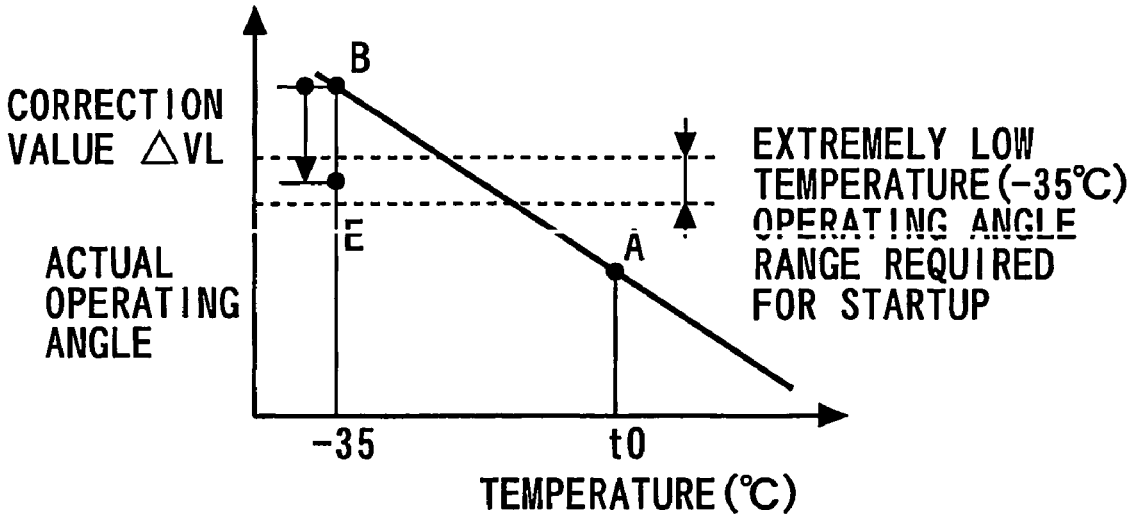
FIG. 10 is a characteristic diagram illustrating a typical modified operation of the variable valve mechanism according to the third embodiment of the present invention.

FIG. 9 is a flowchart illustrating a routine that the ECU 28 performs to implement the above functionality. It is assumed that the routine is started at internal combustion engine startup. The routine first detects actual operating angle A in accordance with the output of the rotation angle sensor 26 and detects the cooling water temperature THW in accordance with the output of the water temperature sensor 29. The detected cooling water temperature THW is handled as the engine temperature t0, that is, the ambient temperature of the variable valve mechanism 30 (step 100).

Next, step 102 is performed to judge whether a request for an internal combustion engine stop is generated. More specifically, step 102 is performed to judge whether the vehicle's ignition switch status is changed from ON to OFF. If the judgment result indicates that no stop request is generated, the routine performs processing step 100 again. If, on the other hand, the judgment result indicates that a stop request is generated, step 104 is performed to calculate the assumed restart temperature of the internal combustion engine. More specifically, step 104 is performed to calculate the difference (Δt=t0−(−35° C.)) between the lowest temperature within the operating temperature range (−35° C.) and the current engine temperature, that is, the stop state temperature t0.

Next, the non-corrective restart state operating angle B (see FIG. 6) is calculated. More specifically, step 106 is performed to calculate an operating angle that is expected to arise in reality when the ambient temperature of the variable valve mechanism 30 lowers to the assumed restart temperature with the rotation position of the control shaft 12 left uncorrected, that is, an operating angle that is expected to arise at an extremely low temperature (−35° C.) when the current status of the control shaft 12 is maintained. The ECU 28 stores a map or arithmetic expression (e.g., y=ax+b or other similar linear expression) representing a temperature/actual operating angle relationship that looks like FIG. 8. In step 106, the non-corrective restart state operating angle B is calculated by applying stop state actual operating angle A and temperature difference Δt=t0−(−35° C.) to the relationship.

Next, step 108 is performed to calculate the correction value ΔVL (see FIG. 8). More specifically, step 108 is performed to calculate the correction value ΔVL, which makes the non-corrective restart state operating angle B be within the operating angle range required for extremely cold startup. The ECU 28 stores a central value E for the operating angle range required for extremely cold startup, and solves the expression B-E to calculate the correction value ΔVL.

Next, step 110 is performed to decrease the stop state operating angle A by the correction value ΔVL and perform a process for achieving the stop state target operating angle F (see FIG. 8). More specifically, the motor 22 is driven to adjust the rotation position of the control shaft 12 so that the actual operating angle is decreased by the correction value ΔVL.

When the above process terminates, the operating angle control process comes to a stop, thereby terminating the routine shown in FIG. 9. In the above process, actual operating angle A can be changed to the stop state target operating angle F at the time of an internal combustion engine stop in anticipation that the ambient temperature of the variable valve mechanism 30 will. subsequently decrease to an extremely low level (−35° C.). If, in this instance, the ambient temperature of the variable valve mechanism 30 actually lowers to an extremely low level before an attempt is made to restart the internal combustion engine, the cranking sequence can be initiated with actual operating angle E, which falls within the operating angle range required for extremely cold startup.

Thus, the variable valve mechanism 30 according to the present embodiment can constantly provide the internal combustion engine with excellent startability at an extremely low temperature. The higher the temperature for startup is, the more excellent the internal combustion engine startability becomes. Consequently, if the employed conditions make it possible to obtain excellent startability at an extremely low temperature, excellent startability can be obtained within the entire temperature range. As a result, the variable valve mechanism 30 according to the present embodiment can properly restart the internal combustion engine in any environment.

When the operating angle control method described above is used, the rotation position adjustment for the control shaft 12, which is made in preparation for a restart, can be terminated while the internal combustion engine is stopped. In this instance, the cranking sequence can be started immediately at a restart without changing the status of the control shaft 12. After an internal combustion engine restart is requested, the variable valve mechanism according to the present embodiment can therefore start a cranking sequence as needed for the restart.

However, the rotation position adjustment of the control shaft 12, which is made in preparation for a restart, is not always made at the time of an internal combustion engine stop. For example, the rotation position adjustment may alternatively be made at the time when an internal combustion engine restart is requested. FIG. 10 illustrates a processing procedure that is to be performed in the above alternative case. If the rotation position adjustment of the control shaft 12 is to be made upon receipt of a startup request, the actual operating angle of the valve body 32 changes along a straight line passing through point A in FIG. 10 during in a process during which the engine temperature lowers after an internal combustion engine stop. When the ambient temperature of the variable valve mechanism 30 decreases to an extremely low level, the actual operating angle changes to B.

When stop state temperature t0 and stop state operating angle A are detected, the use of the above method makes it possible to calculate the correction value ΔVL no matter whether the rotation position adjustment of the control shaft 12 is made at the time of an internal combustion engine stop or startup. Therefore, when the correction value ΔVL is calculated by the above method at the time of an internal combustion engine stop or startup and the rotation position of the control shaft 12 is adjusted by the correction value ΔVL at internal combustion engine startup, it is possible to change the actual operating angle from B to E, that is, it is possible to form a situation in which the actual operating angle falls within the operating angle range required for extremely cold startup immediately after a startup request is generated. If a cranking sequence is initiated while the actual operating angle is within the operating angle range required for extremely cold startup, it is possible to implement a variable valve mechanism that is capable of providing the internal combustion engine with excellent startability at any temperature as is the case with the third embodiment.

In the third embodiment, which has been described above, the first arm member 44 and second arm member 46 correspond to the "adjustment mechanism" according to the aforementioned sixth aspect of the present invention. Further, the water temperature sensor 29 corresponds to the "temperature detection unit" according to the sixth aspect of the present invention. Furthermore, the rotation angle sensor 26 corresponds to the "status detection sensor" according to the sixth aspect of the present invention. The "stop state temperature acquisition unit" according to the sixth aspect of the present invention is implemented when the ECU 28 detects the engine temperature t0 in step 100. The "stop state characteristic value detection unit" is implemented when the ECU 28 detects actual operating angle A. The "non-corrective restart state characteristic value calculation unit" according to the sixth aspect of the present invention is implemented when the ECU 28 performs processing step 106. The "correction value calculation unit" according to the sixth aspect of the present invention is implemented when the ECU 28 performs processing step 108. The "pre-startup correction unit" according to the sixth aspect of the present invention is implemented when the ECU 28 performs processing step 110.

Fourth Embodiment

A fourth embodiment of the present invention will now be described with reference to FIGS. 11 and 12. The variable valve mechanism according to the fourth embodiment is structured the same as the variable valve mechanism according to the first embodiment. The variable valve mechanism according to the fourth embodiment has appropriate characteristics for use with an economy-run vehicle having a so-called idling stop function, a hybrid automobile, and other vehicles incorporating an internal combustion engine having an automatic stop/automatic start function. A case where the variable valve mechanism according to the present embodiment is used in conjunction with a vehicle having an automatic stop/automatic start function will be described below.

Figure 11:
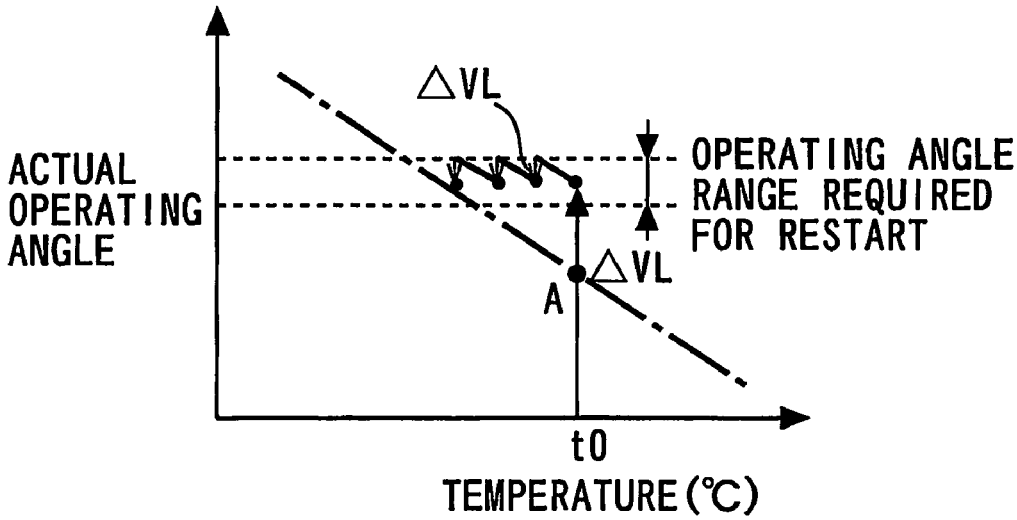
FIG. 11 is a characteristic diagram illustrating the operation of the variable valve mechanism according to a fourth embodiment of the present invention.

FIG. 11 illustrates a method for controlling the control shaft 12 that is used in the variable valve mechanism according to the present embodiment. The one-dot chain line in FIG. 11 represents the relationship that is established between the ambient temperature and actual operating angle of the variable valve mechanism 30 when the rotation position of the control shaft 12 is fixed at a position that passes through point A. Since the variable valve mechanism 30 according to the present embodiment is configured the same as the variable valve mechanism according to the first embodiment, the actual operating angle of the valve body 32 exhibits the same temperature characteristic as in the first embodiment. After the internal combustion engine is stopped, therefore, the actual operating angle of the valve body 32 changes with a decrease in the engine temperature even when the rotation position of the control shaft 12 is fixed.

In an economy-run vehicle or hybrid vehicle, the internal combustion engine frequently repeats an automatic stop/automatic start sequence. It is demanded that the internal combustion engine in such a vehicle automatically start in a comfortable manner. To meet such a demand, it is necessary that the actual operating angle of the valve body 32 be controlled to a value that sufficiently withstands vibration and the like at the time of internal combustion engine startup.

The "operating angle range required for restart", which is indicated by two horizontal broken lines in FIG. 11, represents an operating angle range within which the above demand is met. The operating angle range required for restart is an operating angle range appropriate for internal combustion engine startup. Therefore, while the internal combustion engine is requested to perform a normal operation, the actual operating angle is generally outside the operating angle range required for restart. Consequently, the internal combustion engine generally stops in a state where the actual operating angle is outside the operating angle range required for restart (e.g., in a state where actual operating angle A prevails). To obtain excellent startability, it is necessary to adjust the rotation position of the control shaft 12 during the time interval between an engine stop and an attempt to restart the engine so that actual operating angle A falls within the operating angle range required for restart.

It is preferred that the internal combustion engine properly responds to a startup request. Excellent responsiveness is demanded particularly for an economy-run vehicle or hybrid vehicle in which a start/stop sequence is frequently repeated. To improve the response to a startup request, it is desirable that the adjustment for confining the actual operating angle within the operating angle range required for restart be completed prior to the generation of a startup request. Under these circumstances, the present embodiment adjusts the rotation position of the control shaft 12 so that the actual operating angle A changed to a value within the operating angle range required for restart immediately after stop of the internal combustion engine, then the actual operating angle stays within the operating angle range required for restart without regard to temperature changes, as indicated by a solid polygonal line (arrow marks included) in FIG. 11. In this instance, since the actual operating angle always remains within the operating angle range required for restart, an automatic start can be quickly achieved simply by initiating a cranking sequence immediately whenever an internal combustion engine automatic start is requested.

Figure 12:
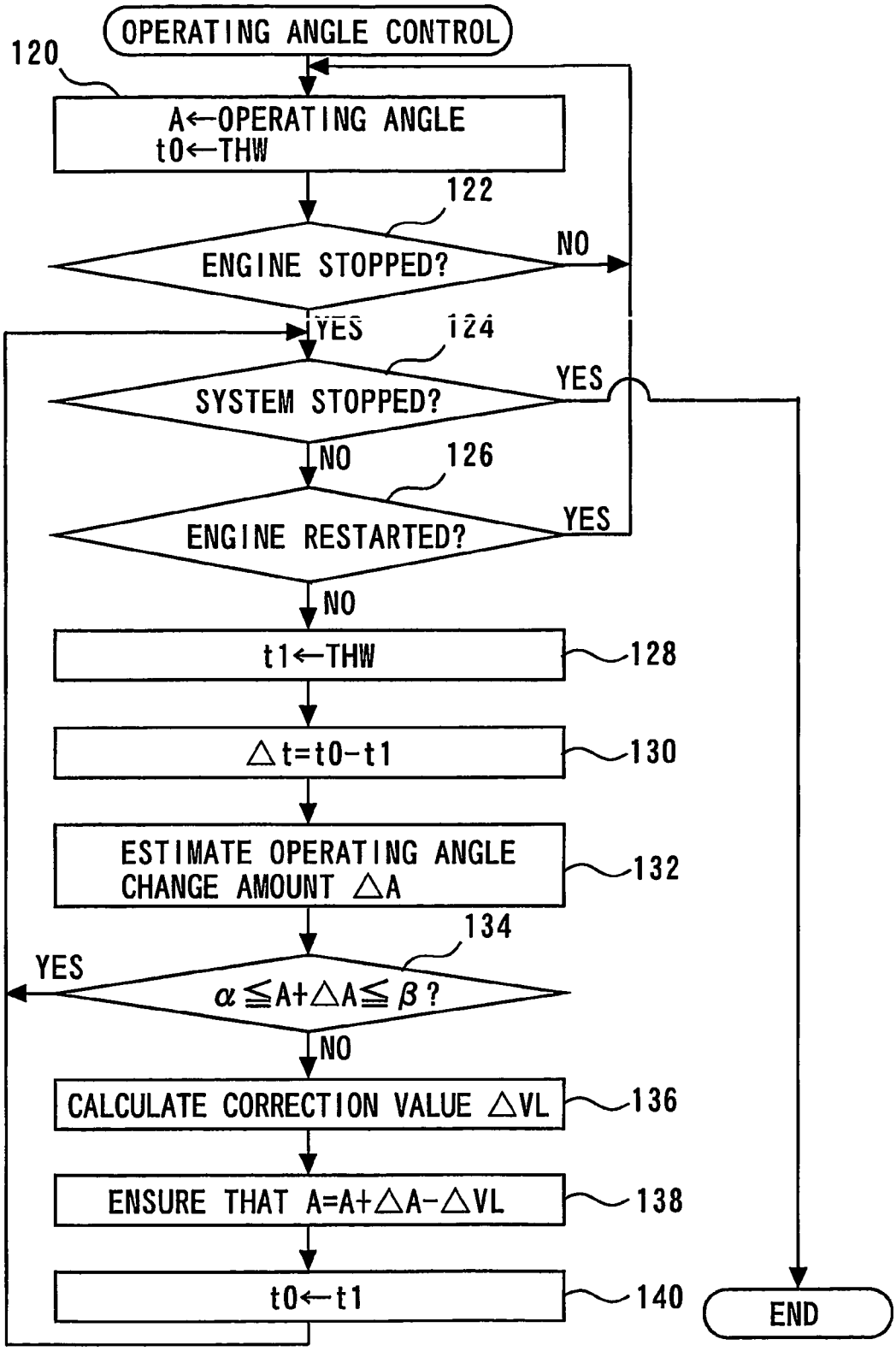
FIG. 12 is a flowchart illustrating a routine that is executed in accordance with the fourth embodiment of the present invention.

FIG. 12 is a flowchart illustrating a routine that the ECU 28 according to the present embodiment performs to implement the above functionality. It is assumed that the routine is initiated when the system for an economy-run or hybrid vehicle starts up. The routine first detects actual operating angle A in accordance with the output of the rotation angle sensor 26 and the cooling water temperature THW in accordance with the output of the water temperature sensor 29. The detected cooling water temperature THW is handled as the engine temperature t0, that is, the ambient temperature of the variable valve mechanism 30 (step 120).

Next, step 122 is performed to judge whether a request for an internal combustion engine stop is generated. If the judgment result indicates that no engine stop request is generated, the routine performs processing step 120 again. If, on the other hand, the judgment result indicates that an engine stop request is generated, step 124 is performed to judge whether a request for a vehicle system stop is generated. If the judge result indicates that a request for a vehicle system stop is generated, the routine immediately terminates the current processing cycle. If, on the other hand, the judgment result indicates that no request is generated for a vehicle system stop, step 126 is performed to judge whether a request for an internal combustion engine restart is generated.

When a request for an internal combustion engine stop is generated, the system according to the present embodiment brings the internal combustion engine to an automatic stop. If a request for an internal combustion engine restart is generated later, the system automatically starts up the internal combustion engine. Therefore, the internal combustion engine is kept stopped during the time interval between the instant at which the request for an engine stop is recognized in step 122 and the instant at which the request for a restart is recognized. During such a time interval, the ambient temperature of the variable valve mechanism 30 continuously lowers while processing steps 128 and beyond are performed inside the ECU 28 as described below.

In the above instance, the ECU 28 first detects the current cooling water temperature THW as the stop period temperature t1 of the internal combustion engine (step 128). Next, step 130 is performed to calculate the difference between the stop state temperature t0 and the stop period temperature t1, that is, the temperature difference ($\Delta t = t0 - t1$) that has arisen in the temperature around the variable valve mechanism 30 after an internal combustion engine stop.

Next, step 132 is performed to calculate the amount of an operating angle change $\Delta A$ that has possibly occurred in the actual operating angle after an internal combustion engine stop. The ECU 28 stores a map or arithmetic expression (e.g., $y = ax + b$ or other similar linear expression) representing a temperature/actual operating angle relationship that looks like FIG. 11. In step 132, the operating angle change amount $\Delta A$ is calculated by applying the temperature difference ($\Delta t = t0 - t1$) to the relationship.

Next, step 134 is performed to judge whether $A + \Delta A$ is equal to or larger than the lower-limit value $\alpha$ of the operating angle range required for restart and equal to or lower than the upper-limit value $\beta$ of the operating angle range required for restart. If the actual operating angle is changed by $\Delta A$ after an internal combustion engine stop, it can be estimated that the current actual operating angle is equal to $A + \Delta A$, which is calculated by adding the operating angle change amount $\Delta A$ to the stop state operating angle A. More specifically, step 134 is performed to judge whether its actual operating angle $A + \Delta A$ is within the operating angle range required for restart.

While the internal combustion engine is stopped, the actual operating angle A is often outside the operating angle range required for restart. Further, immediately after an internal combustion engine stop, the generated operating angle change amount $\Delta A$ is not enough to cancel the deviation of the actual operating angle A from the operating angle range required for restart. At the above timing, therefore, the condition of step 134 is not generally satisfied. In such an instance, the difference between the latest actual operating angle $A + \Delta A$ and the middle value of the operating angle range required for restart is calculated as the correction value $\Delta VL = (A + \Delta A) - \{(\alpha + \beta)/2\}$ (Step 136).

Next, the rotation position of the control shaft 12 is adjusted to change the actual operating angle by the correction value $\Delta VL$ so that the new actual operating angle is equal to $A + \Delta A - \Delta VL$. The resulting actual operating angle ($A + \Delta A - \Delta VL$) is then stored as the latest actual operating angle A (step 138). Further, if the above adjustment is made, the currently detected stop period temperature t1 is stored anew as the new temperature t0 (step 140). Subsequently, processing steps 124 and beyond are performed again.

When the above process is performed, the actual operating angle A can be changed to the middle value of the operating angle range required for restart immediately after the internal combustion engine is brought to an automatic stop. It is also possible to store the resulting latest actual operating angle as the new actual operating angle A and the temperature prevailing at the time of such a change as the new temperature t0.

Subsequently, processing steps 128 through 140, which have been described above, are repeatedly performed as far as the system for an economy-run or hybrid vehicle itself is not stopped and no request is generated for an internal combustion engine restart. In this instance, step 130 is performed to calculate the difference between the temperature t0 prevailing when the control shaft 12 is adjusted and the current stop period temperature t1 as the temperature difference $\Delta t$. Further, step 134 is performed to calculate the sum of the actual operating angle A achieved by adjusting the control shaft 12 and the operating angle change $\Delta A$ invoked after such an adjustment as the latest actual operating angle $A + \Delta A$, and judge whether the calculated latest actual operating angle $A + \Delta A$ is within the operating angle range required for restart.

Immediately after the control shaft 12 is adjusted, the resulting operating angle change amount ΔA is not great. Therefore, the latest actual operating angle A+ΔA is within the operating angle range required for restart. In this instance, the condition of step 134 is denied, and then steps 124 and beyond are performed again. If an adequate amount of time elapses after the control shaft 12 is adjusted, the stop period temperature t1 drops so that the latest actual operating angle A+ΔA is outside the operating angle range required for restart again. In this instance, the specified condition is not met in step 134 so that the rotation position of the control shaft 12 is adjusted again (steps 136 through 140).

When the above process is repeated, the actual operating angle stays within the operating angle range required for restart while the internal combustion engine is brought to an automatic stop. Therefore, when a restart request is generated after the internal combustion engine is brought to an automatic stop, the variable valve mechanism according to the present embodiment can properly restart the internal combustion engine with excellent responsiveness. After an internal combustion engine restart is requested, the routine shown in FIG. 12 performs step 126 to judge the specified condition is met, and then repeats processing steps 120 and beyond.

Figure 13:
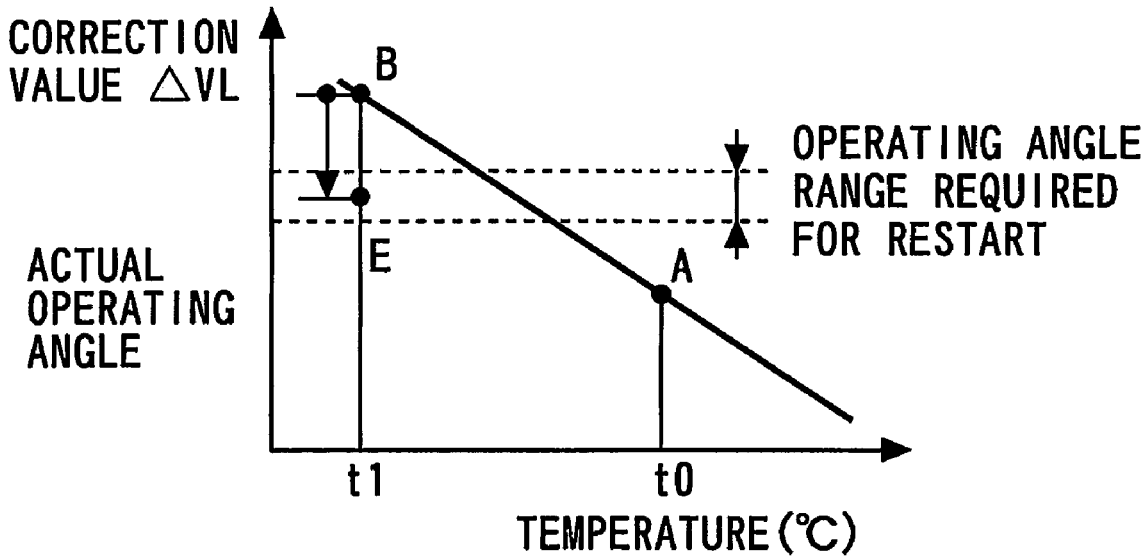
FIG. 13 is a characteristic diagram illustrating a typical modified operation of the variable valve mechanism according to the fourth embodiment of the present invention.

The fourth embodiment, which has been described above, gives priority to responsiveness for a restart. Therefore, the fourth embodiment assumes that the actual operating angle stays within the operating angle range required for restart while the internal combustion engine is stopped. However, the present invention is not limited to such an assumption. For example, the actual operating angle may alternatively fall within the operating angle range required for restart when a restart is requested. FIG. 13 illustrates the associated processing sequence. If the actual operating angle is corrected when a start request is generated, the actual operating angle changes along a straight line passing through point A in FIG. 13 during a process during which the engine temperature lowers after an internal combustion engine stop.

If, in the above instance, the temperature t1 prevailing at the time of restart request generation is known in addition to the stop state operating angle A and stop state temperature t0, the actual operating angle B prevailing at the time of the restart request generation can be determined. If the prevailing actual operating angle B is determined, the correction value ΔVL for confining the actual operating angle B within the operating angle range required for restart can be calculated. Therefore, excellent startability can be obtained even if the process for calculating the correction value ΔVL is repeated during an internal combustion engine stop, and only the control shaft 12 is adjusted to implement the correction value ΔVL prior to the start of cranking at the time of restart request generation.

If the time required for calculating the correction value ΔVL does not significantly affect the responsiveness at startup, the cranking sequence may be initiated, without performing any process during an internal combustion engine stop, after sequentially performing the process for calculating the correction value ΔVL according to the prevailing temperature t1 and the process for controlling the control shaft 12 for implementing the correction value ΔVL when an internal combustion engine restart is requested. Even when the above method is used, it is possible to restart the internal combustion engine at an appropriate actual operating angle and provide the internal combustion engine with excellent startability.

The fourth embodiment, which has been described above, assumes that the variable valve mechanism is used with an economy-run vehicle engine, hybrid vehicle engine, or other internal combustion engine having an automatic stop/start function. However, the present invention is not limited to such use. More specifically, the present invention provides an optimum operating angle and lift amount, which are suitable for startup, at a prevailing actual engine temperature t1 when internal combustion engine startup is requested. Therefore, the variable valve mechanism according to the present invention is also instrumental in improving the startability of common internal combustion engines.

In the fourth embodiment, which has been described above, the first arm member 44 and second arm member 46 correspond to the "adjustment mechanism" according to the aforementioned ninth aspect of the present invention. Further, the water temperature sensor 25 corresponds to the "temperature detection unit" according to the ninth aspect of the present invention. Furthermore, the rotation angle sensor 22 corresponds to the "status detection sensor" according to the ninth aspect of the present invention. The "stop state characteristic value detection unit" and "stop state temperature acquisition unit" according to the ninth aspect of the present invention are implemented when the ECU 24 detects the actual operating angle A and engine temperature t0 in step 120. The "stop period temperature acquisition unit" according to the ninth aspect of the present invention is implemented when the ECU 24 detects the stop period temperature t1 in step 128. The "stop period correction unit" according to the ninth aspect of the present invention is implemented when the ECU 24 performs processing step 138.

In the fourth embodiment, which has been described above, the "first characteristic value change amount calculation unit" according to the tenth aspect of the present invention is implemented when the ECU 24 performs processing steps 130 and 132 immediately after an internal combustion engine stop. The "first actual characteristic value calculation unit" according to the tenth aspect of the present invention is implemented when the ECU 24 calculates A+ΔA in step 134 immediately after an internal combustion engine stop. The "suitability judgment unit" according to the tenth aspect of the present invention is implemented when the ECU 24 performs step 134 to judge whether the condition ($\alpha \leqq A+\Delta A \leqq \beta$) is met. The "control shaft correction unit" according to the tenth aspect of the present invention is implemented when the ECU 24 drives the control shaft 12 in step 138. The "post-correction characteristic value calculation unit" according to the tenth aspect of the present invention is implemented when the ECU 24 performs step 138 to calculate A+ΔA−ΔVL as a new actual operating angle A. The "second characteristic value change amount calculation unit" according to the tenth aspect of the present invention is implemented when the ECU 24 performs processing steps 130 and 132 after the control shaft 12 is corrected. The "second actual characteristic value calculation unit" according to the tenth aspect of the present invention is implemented when the ECU 24 calculates A+ΔA in step 134 after the control shaft 12 is corrected.

In the fourth embodiment, which has been described above, the first arm member 44 and second arm member 46 correspond to the "adjustment mechanism" according to the aforementioned eleventh aspect of the present invention. Further, the water temperature sensor 25 corresponds to the "temperature detection unit" according to the aforementioned eleventh aspect of the present invention. Furthermore, the rotation angle sensor 22 corresponds to the "status detection sensor" according to the eleventh aspect of the present invention. The "stop state temperature acquisition unit" and "stop state characteristic value detection unit" according to the eleventh aspect of the present invention are implemented when the ECU 24 detects the engine temperature t0 and actual operating angle A in step 120. The "restart request state temperature acquisition unit" according to the eleventh aspect of the present invention is implemented when the ECU 24 detects the engine temperature upon restart request generation. The "non-corrective restart request state characteristic value calculation unit" according to the eleventh aspect of the present invention is implemented when the ECU 24 calculates the actual operating angle A+ΔA (see steps 130 through 134) with the engine temperature prevailing at a restart regarded as t1. The "correction value calculation unit" according to the eleventh aspect of the present invention is implemented when the ECU 24 performs processing step 136. The "pre-restart correction unit" according to the eleventh aspect of the present invention is implemented when the ECU 24 performs processing step 138.

The invention claimed is:

1. A variable valve mechanism that is capable of changing the operating angle and/or lift amount of a valve body of an internal combustion engine, the variable valve mechanism comprising:

a control shaft whose status is controlled so as to change said operating angle and/or lift amount;

a swinging arm that is positioned between a cam and a valve body to swing in synchronism with cam rotation, thereby transmitting the force of the cam to said valve body;

an adjustment mechanism for changing the basic relative angle of said swinging arm in relation to said valve body in accordance with the status of said control shaft;

temperature detection means for detecting or estimating the ambient temperature of said control shaft and said cam; and temperature correction means for correcting the status of said control shaft in accordance with said temperature and in order to avoid the influence of the temperature.

2. The variable valve mechanism according to claim 1, further comprising:

a sensor for detecting the status of said control shaft;

an actuator for driving said control shaft; and actuator control means for controlling a control value of said actuator in accordance with the output of said sensor, wherein said temperature correction means corrects the control value of said actuator in accordance with said temperature.

3. The variable valve mechanism according to claim 2, wherein said temperature correction means corrects the output of said sensor in accordance with said temperature; and wherein said actuator control means controls the control value of said actuator in accordance with the corrected sensor output.

4. The variable valve mechanism according to claim 1, further comprising:

a sensor for detecting the status of said control shaft;

an actuator for driving said control shaft;

target status setup means for setting the target status of said control shaft; and actuator control means for controlling said actuator so that the output of said sensor matches the target status of said control shaft, wherein said temperature correction means corrects the target status of said control shaft in accordance with said temperature.

5. The variable valve mechanism according to claim 1, wherein said temperature correction means comprising:

a status detection sensor for detecting the status of said control shaft;

stop state temperature acquisition means for acquiring said ambient temperature at the time of an internal combustion engine stop as a stop state temperature;

stop state characteristic value detection means for detecting the operating angle and/or the lift amount at the time of an internal combustion engine stop as a stop state characteristic value in accordance with the status of said control shaft;

stop period temperature acquisition means for acquiring said ambient temperature during an internal combustion engine stop as a stop period temperature; and stop period correction means for correcting the status of said control shaft during an internal combustion engine stop so that the operating angle and/or lift amount are maintained suitable for a restart in accordance with said stop state temperature, said stop state characteristic value, and said stop period temperature.

6. The variable valve mechanism according to claim 5, wherein said stop period correction means including:

first characteristic value change amount calculation means for calculating a first characteristic value change amount in accordance with said stop state temperature and said stop period temperature;

first actual characteristic value calculation means for calculating the sum of said stop state characteristic value and said first characteristic value change amount as an actual characteristic value;

suitability judgment means for judging whether the calculated actual characteristic value is suitable for a restart;

control shaft correction means, which, when the actual characteristic value is judged to be unsuitable for a restart, corrects the status of said control shaft so that the actual characteristic value is suitable for a restart;

post-correction characteristic value calculation means for calculating a post-correction characteristic value that is obtained by correcting said control shaft;

second characteristic value change amount calculation means for calculating a second characteristic value change amount in accordance with a change in said stop period temperature that is caused after said control shaft is corrected; and second actual characteristic value calculation means for calculating the sum of said post-correction characteristic value and said second characteristic value change amount as an actual characteristic value.

7. The variable valve mechanism according to claim 5, wherein said internal combustion engine is capable of automatically stopping and starting without requiring an operator intervention.

8. The variable valve mechanism according to claim 1, wherein said temperature correction means comprising:

a status detection sensor for detecting the status of said control shaft;

stop state temperature acquisition means for acquiring said ambient temperature at the time of an internal combustion engine stop as a stop state temperature;

stop state characteristic value detection means for detecting the operating angle and/or the lift amount at the time of an internal combustion engine stop as a stop state characteristic value in accordance with the status of said control shaft;

restart request state temperature acquisition means for acquiring said ambient temperature upon a request for an internal combustion engine restart as a restart request state temperature;

non-corrective restart request state characteristic value calculation means for calculating a non-corrective restart request state characteristic value in accordance with said stop state characteristic value and the difference between said restart request state temperature and said stop state temperature;

correction value calculation means for calculating a correction value for converting said non-corrective restart request state characteristic value into a characteristic value suitable for a restart; and pre-restart correction means for correcting the status of said control shaft prior to an internal combustion engine restart so that the operating angle and/or lift amount change in accordance with said correction value.

9. A variable valve mechanism that is capable of changing the operating angle and/or lift amount of a valve body of an internal combustion engine, the variable valve mechanism comprising:

a control shaft whose status is controlled so as to change said operating angle and/or lift amount;

an swinging arm that is positioned between a cam and a valve body to oscillate in synchronism with cam rotation, thereby transmitting the force of the cam to said valve body; and an adjustment mechanism for changing the basic relative angle of said swinging arm in relation to said valve body in accordance with the status of said control shaft, wherein a member for determining the distance between said control shaft and a camshaft and a member positioned between said control shaft and said cam are made of materials having the same linear expansion coefficient.

10. The variable valve mechanism according to claim 1, wherein said temperature correction means comprising:

a status detection sensor for detecting the status of said control shaft;

stop state temperature acquisition means for acquiring said ambient temperature at the time of an internal combustion engine stop as a stop state temperature;

stop state characteristic value detection means for detecting the operating angle and/or the lift amount at the time of an internal combustion engine stop as a stop state characteristic value in accordance with the status of said control shaft;

non-corrective restart state characteristic value calculation means for calculating a non-corrective restart state characteristic value in accordance with said stop state characteristic value and the difference between an assumed restart temperature of the internal combustion engine and said stop state temperature;

correction value calculation means for calculating a correction value for converting said non-corrective restart state characteristic value into an operating angle and/or lift amount suitable for said assumed restart temperature; and pre-startup correction means for correcting the status of said control shaft prior to an internal combustion engine restart so that the operating angle and/or lift amount change in accordance with said correction value.

11. The variable valve mechanism according to claim 10, wherein said pre-startup correction means corrects the status of said control shaft at time of an internal combustion engine stop so that the operating angle and/or lift amount change in accordance with said correction value.

12. The variable valve mechanism according to claim 10, wherein said assumed restart temperature is the lowest temperature within an operating temperature range of the internal combustion engine.

13. A variable valve mechanism that is capable of changing the operating angle and/or lift amount of a valve body of an internal combustion engine, the variable valve mechanism comprising:

a control shaft whose status is controlled so as to change said operating angle and/or lift amount;

a swinging arm that is positioned between a cam and a valve body to swing in synchronism with cam rotation, thereby transmitting the force of the cam to said valve body;

an adjustment mechanism for changing the basic relative angle of said swinging arm in relation to said valve body in accordance with the status of said control shaft;

temperature detection unit for detecting or estimating the ambient temperature of said control shaft and said cam; and temperature correction unit for correcting the status of said control shaft in accordance with said temperature and in order to avoid the influence of the temperature.

14. The variable valve mechanism according to claim 13, further comprising:

a sensor for detecting the status of said control shaft;

an actuator for driving said control shaft; and actuator control unit for controlling a control value of said actuator in accordance with the output of said sensor, wherein said temperature correction unit corrects the control value of said actuator in accordance with said temperature.

15. The variable valve mechanism according to claim 14, wherein said temperature correction unit corrects the output of said sensor in accordance with said temperature; and wherein said actuator control unit controls the control value of said actuator in accordance with the corrected sensor output.

16. The variable valve mechanism according to claim 13, further comprising:

a sensor for detecting the status of said control shaft;

an actuator for driving said control shaft;

target status setup unit for setting the target status of said control shaft; and actuator control unit for controlling said actuator so that the output of said sensor matches the target status of said control shaft, wherein said temperature correction unit corrects the target status of said control shaft in accordance with said temperature.

17. The variable valve mechanism according to claim 13, wherein said temperature correction unit comprising:

a status detection sensor for detecting the status of said control shaft;

stop state temperature acquisition unit for acquiring said ambient temperature at the time of an internal combustion engine stop as a stop state temperature;

stop state characteristic value detection unit for detecting the operating angle and/or the lift amount at the time of an internal combustion engine stop as a stop state characteristic value in accordance with the status of said control shaft;

non-corrective restart state characteristic value calculation unit for calculating a non-corrective restart state characteristic value in accordance with said stop state characteristic value and the difference between an assumed restart temperature of the internal combustion engine and said stop state temperature;

correction value calculation unit for calculating a correction value for converting said non-corrective restart state characteristic value into an operating angle and/or lift amount suitable for said assumed restart temperature; and pre-startup correction unit for correcting the status of said control shaft prior to an internal combustion engine restart so that the operating angle and/or lift amount change in accordance with said correction value.

18. The variable valve mechanism according to claim 17, wherein said pre-startup correction unit corrects the status of said control shaft at time of an internal combustion engine stop so that the operating angle and/or lift amount change in accordance with said correction value.

19. The variable valve mechanism according to claim 13, wherein said temperature correction unit comprising:

a status detection sensor for detecting the status of said control shaft;

stop state temperature acquisition unit for acquiring said ambient temperature at the time of an internal combustion engine stop as a stop state temperature;

stop state characteristic value detection unit for detecting the operating angle and/or the lift amount at the time of an internal combustion engine stop as a stop state characteristic value in accordance with the status of said control shaft;

stop period temperature acquisition unit for acquiring said ambient temperature during an internal combustion engine stop as a stop period temperature; and stop period correction unit for correcting the status of said control shaft during an internal combustion engine stop so that the operating angle and/or lift amount are maintained suitable for a restart in accordance with said stop state temperature, said stop state characteristic value, and said stop period temperature.

20. The variable valve mechanism according to claim 19, wherein said stop period correction unit including:

first characteristic value change amount calculation unit for calculating a first characteristic value change amount in accordance with said stop state temperature and said stop period temperature;

first actual characteristic value calculation unit for calculating the sum of said stop state characteristic value and said first characteristic value change amount as an actual characteristic value;

suitability judgment unit for judging whether the calculated actual characteristic value is suitable for a restart;

control shaft correction unit, which, when the actual characteristic value is judged to be unsuitable for a restart, corrects the status of said control shaft so that the actual characteristic value is suitable for a restart;

post-correction characteristic value calculation unit for calculating a post-correction characteristic value that is obtained by correcting said control shaft;

second characteristic value change amount calculation unit for calculating a second characteristic value change amount in accordance with a change in said stop period temperature that is caused after said control shaft is corrected; and second actual characteristic value calculation unit for calculating the sum of said post-correction characteristic value and said second characteristic value change amount as an actual characteristic value.

21. The variable valve mechanism according to claim 13, wherein said temperature correction unit comprising:

a status detection sensor for detecting the status of said control shaft;

stop state temperature acquisition unit for acquiring said ambient temperature at the time of an internal combustion engine stop as a stop state temperature;

stop state characteristic value detection unit for detecting the operating angle and/or the lift amount at the time of an internal combustion engine stop as a stop state characteristic value in accordance with the status of said control shaft;

restart request state temperature acquisition unit for acquiring said ambient temperature upon a request for an internal combustion engine restart as a restart request state temperature;

non-corrective restart request state characteristic value calculation unit for calculating a non-corrective restart request state characteristic value in accordance with said stop state characteristic value and the difference between said restart request state temperature and said stop state temperature;

correction value calculation unit for calculating a correction value for converting said non-corrective restart request state characteristic value into a characteristic value suitable for a restart; and pre-restart correction unit for correcting the status of said control shaft prior to an internal combustion engine restart so that the operating angle and/or lift amount change in accordance with said correction value.

* * * * *